US006672240B1

(12) United States Patent
Aubé et al.

(10) Patent No.: US 6,672,240 B1
(45) Date of Patent: Jan. 6, 2004

(54) DECK BOAT

(75) Inventors: Martin Aubé, St-Bruno-de-Montarville (CA); David Kalhok, Marlon, IL (US); Alain Rheault, Longueuil (CA); Rick Adamczyk, St. Cloud, FL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/635,262

(22) Filed: Aug. 9, 2000

Related U.S. Application Data

(60) Provisional application No. 60/168,676, filed on Dec. 3, 1999.

(30) Foreign Application Priority Data

Aug. 9, 1999 (CA) ..... 2279804

(51) Int. Cl.[7] ..... B63B 17/00; B63H 11/00; B63H 21/38

(52) U.S. Cl. ..... 114/343; 114/361; 114/362; 114/363; 114/364; 440/38; 440/89 R

(58) Field of Search ..... 114/343, 361, 114/362, 363, 364, 85, 255, 55.53, 242, 56.1; 440/89, 43, 38, 40, 41, 42, 39; D12/300, 317; 441/71

(56) References Cited

U.S. PATENT DOCUMENTS 2,766,714 A * 10/1956 Hammers ..... 440/89
3,290,706 A * 12/1966 Hale ..... 114/361
3,339,516 A * 9/1967 Lenci ..... 440/39
3,428,976 A * 2/1969 Robinson ..... 114/361
3,811,143 A * 5/1974 Page ..... 114/343
3,823,431 A * 7/1974 Miller
3,949,700 A * 4/1976 Baroody
4,033,280 A * 7/1977 Wood et al. ..... 114/343
4,040,693 A * 8/1977 Peterson et al. ..... 312/236
4,145,770 A * 3/1979 Zaris ..... 114/264
4,742,795 A * 5/1988 DePrey et al. ..... 114/343
4,883,016 A * 11/1989 Larson ..... 114/364
4,957,056 A * 9/1990 Martin ..... 114/361
5,029,348 A 7/1991 Boren
5,095,843 A * 3/1992 Kobayashi ..... 114/360
5,123,372 A * 6/1992 Kobahashi et al. ..... 114/362
5,136,963 A * 8/1992 Zuzik ..... 114/343
5,143,013 A * 9/1992 Huebner ..... 114/343
5,150,663 A * 9/1992 Kobayashi ..... 116/209
5,237,950 A * 8/1993 Abe et al. ..... 114/363
5,331,917 A 7/1994 Magers
5,349,919 A * 9/1994 Douglass ..... 114/85
5,355,826 A * 10/1994 Hattori et al. ..... 114/362
5,366,028 A * 11/1994 Kobayashi ..... 114/362
5,416,670 A * 5/1995 Authier ..... 362/34
5,490,474 A * 2/1996 Ikeda ..... 114/343
5,537,948 A * 7/1996 Kobayashi ..... 114/362

(List continued on next page.)

*Primary Examiner*—Sherman Basinger
(74) *Attorney, Agent, or Firm*—Pillsbury Winthrop LLP

(57) ABSTRACT

Combined herein are the benefits of a flat deck pontoon boat and the speed and versatility of a jet propelled watercraft. The watercraft is equipped with a propulsion source sufficient to move the watercraft at a substantial speed through the water. The seating layout on the deck provides the amenities of an extremely comfortable watercraft capable of seating multiple passengers while providing sufficient storage space for all necessary items for such a voyage. The watercraft is equipped with a substantially flat deck area with an upper bow deck and a lowered recess area which, when filled with water, provides cooling and amusement for the passengers. The watercraft is equipped with a privacy compartment or toilet, a kitchen area, and a double driver seat, which can be rotated from a relaxing position to a driving position. A rear sundeck can be converted into upright seats. Under the kitchen area an ice chest or some other item can be stowed. The layout of the deck on the boat permits passengers to move easily through the passenger areas.

56 Claims, 22 Drawing Sheets

U.S. PATENT DOCUMENTS 5,566,637 A * 10/1996 Benza ..... 114/363
5,572,944 A * 11/1996 Slikkers et al. ..... 114/343
5,775,250 A * 7/1998 Kobayashi et al. ..... 114/258
5,915,329 A * 6/1999 Watkins et al. ..... 114/363
6,062,922 A * 5/2000 Nanami ..... 440/38
6,071,156 A 6/2000 Platzer et al.
6,168,481 B1 * 1/2001 Mardikian ..... 440/39
6,236,826 B1 * 5/2001 Kurz et al. ..... 399/258

* cited by examiner

DECK BOAT

CROSS-REFERENCE

This application claims the benefit of U.S. Provisional Application No. 60/168,676, filed Dec. 3, 1999, and Canadian Application No. 2,279,804, filed Aug. 9, 1999, both of which are incorporated herein by reference.

BACKGROUND OF THE INVENTION

1. Field of the Invention

This invention relates to watercraft and more particularly to features for deck boats.

2. Description of the Related Art

Various types of watercraft exist, each being suited for different types of activities.

For example, one type of boat, the pontoon-type watercraft, is usually equipped with an outboard motor, typically operates at slower speeds, and generally offers a more relaxed ride. Conventionally, chairs and tables are arranged on the deck of the pontoon-type watercraft for cruising and for accommodating a variety of other aquatic activities in space and comfort.

Other types of watercraft, such as sport boats, are designed for higher speeds and sportier handling. In contrast to pontoon boats, sport boats typically do not provide passengers with a sense of comfort and mobility on deck, since the passengers are usually more confined.

While these two types of boats do not define the entire universe of possible options, a gap exists between these two types of watercraft. Accordingly, a need has developed for a watercraft that can provide greater room and mobility for passengers on deck, while also being capable of greater speeds and sportier handling.

SUMMARY OF THE INVENTION

It is, therefore, an object of the present invention to provide a watercraft which combines the roominess of a pontoon-type boat with the thrill and speed which are typically characteristic of a sporty, water vehicle.

One further object of the present invention is to provide a boat with a hull. A front deck is formed as a part of the hull, is integrally formed with the boat, and extends across a bow thereof. The front deck is configured to permit access to at least one of water, a dock, and a beach. The boat may include a jet-propelled power source to power the boat through the water.

A further object of the present invention is to provide a deck boat with a main deck floor having at least two deck portions. A ramp area is included on the boat and defines a gradual transition between the at least two deck portions. The transition defines a gradient.

It is still another object of the present invention to provide a deck boat with a powered hull and a seat configured to accommodate a driver and at least one passenger. The seat is selectively switchable between a driving position and at least one relaxing position.

One further object of the present invention is to provide a deck boat with a main deck. A recess is integrally formed in the main deck and is configured for receiving a predetermined quantity of water.

Another object of the present invention is to provide a deck boat with a main deck and at least one other deck portion arranged adjacent thereto. At least one spraying mechanism is disposed on at least one of the main deck or the other deck portion. The spraying mechanism is adapted to selectively disperse water on either the main deck or the other deck portion.

An additional object of the present invention is to provide a deck boat having a cockpit area. A water spraying mechanism is configured to spray water into the air in the vicinity of the cockpit area.

One further object of the present invention is to provide a deck boat with a main deck portion. At least one second deck portion is arranged adjacent to the main deck portion and a ramp permits passage between the main and the at least one second deck portion. First and second wall portions are positioned along opposite sides of the ramp. A door is hingedly mounted to one of the first or second wall portions and is configured to (i) separate the main deck portion from the second deck portion, and (ii) form a seal with the ramp and the first and second wall portions when configured to separate the main deck portion from the second deck portion.

It is still another object of the present invention to provide a deck boat having a main deck. At least one second deck is integrally formed with the main deck and is rearwardly disposed from the main deck. The second deck has a substantially flat surface and is adapted to accommodate a person boarding the boat from water.

A further object of the present invention is to provide a deck boat including a bow area. A cockpit area is positioned rearward of the bow area with a main deck extending from the cockpit area to the bow area. A recess area is disposed lower than the main deck in the bow area, and a cockpit seat is disposed in the cockpit area on the main deck. The cockpit seat's height is selected in relation to the main deck with a passenger seat disposed adjacent to the recess area. The passenger seat's height is selected in relation to the recess area so that the passenger seat is positioned below the cockpit seat.

Another object of the present invention is to provide a deck boat with a powered hull. A privacy compartment is provided with a closed position that is flush with the hull and an open position that accommodates entry of an average sized adult.

One further object of the present invention is to provide a deck boat having a galley module including a top portion. The galley module is positioned on the powered hull and has a countertop fastened to the top portion. The countertop is formed of a single construction and is configured for mounting at least one of a sink or cooking elements.

Still another object of the present invention is to provide a deck boat with a motor compartment cover and a deck formed on a surface of the motor compartment cover. The deck includes a front portion and a rear portion. The rear portion is selectively changeable between a first position and at least one second position so that the front portion and the rear portion (i) form a substantially flat surface when the rear portion is in the first position and (ii) form a seat when the rear portion is in the at least one second position. The front portion forms the seat bottom and the rear portion forming the seat back.

Another object of the present invention is to provide a deck boat with a gunwale having interior and exterior sides. At least one elongated hollow storage member, with an opening at one end, is disposed within the gunwale. A door is pivotally attached to the gunwale to permit access to the at least one elongated hollow storage member.

One additional object of the present invention is to provide a deck boat with a first gunwale formed on a port side and a second gunwale formed on a starboard side. Each of the first and second gunwales have (i) a length and (ii) an end portion with a location defined by the length. Each end portion is at a stem of the deck boat and the length of one of the first and second gunwales is shorter than the other.

A further object of the present invention is to provide a deck boat including a main deck surface with an opening therein that is adapted to accommodate at least a portion of a motor extending upwardly therethrough. A canopy is pivotally attached to the deck surface and adapted to conceal the upwardly extending portion of the motor. At least one portion of the canopy is selectively changeable between at least two positions, a first where the upwardly extending portion of the motor is concealed and a second where the motor is accessible.

Still another object of the present invention is to provide a deck boat with a powered hull having at least one exterior lighting fixture. The fixture includes a first light adapted to illuminate a first exterior area of the boat and at least one second light adapted to illuminate another exterior area of the boat. The first and second lights are provided in the fixture, which is mountable onto the deck boat as an integral unit.

Another object of the present invention is to provide a deck boat having a powered hull with a steering console thereon. The console includes a top portion with a windshield disposed thereon. The windshield includes a first main portion extending laterally across the top portion of the console and at least one second portion hingedly attached to the first main portion. The at least one second portion (i) is movable between a number of positions and (ii) is configured to extend the windshield beyond the first main portion.

One additional object of the present invention is to provide a deck boat having a hull with a keel. A jet drive power source is disposed within the hull and is configured to (i) produce power along a predetermined direction and (ii) form a drive line based upon the predetermined direction. The drive line bisects a plane of the keel when the jet drive power source produces power.

The present invention also has as one of its objects the provision of a deck boat including a hull defining a stem and a power source for propulsion. The power source is positioned a predetermined distance forward of the stem to prevent contact with a person at the stern. The power source is one of either a jet drive or a propeller.

Another object of the present invention is to provide a deck boat with a powered hull and a console attached to the hull. The console contains a helm, and the helm and the console are formed integrally for attachment to the hull as a single component.

It is also an object of the present invention to provide a deck boat with a powered hull and a number of passenger seating areas therein. Each of the seats has a top portion and includes handles attached thereto below the top portion thereof.

On further object of the present invention is to provide a deck boat having a powered hull with an engine compartment therein. A mechanism, configured to support a ski pole for towing a water skiier, is positioned in the engine compartment.

An additional object of the present invention is to provide a deck boat having a powered hull and an exhaust port for channeling engine exhaust from a rear of the hull. The exhaust port has a first end adapted for connection with an engine and a second end (i) that extends in an aft direction and (ii) is disposed a predetermined distance beyond a rear hull of the boat.

Other objects of the present invention are discussion herein or will be made apparent by the description that follows.

BRIEF DESCRIPTION OF THE DRAWINGS

The accompanying drawings, which are incorporated in and constitute a part of the specification, illustrate embodiments of the invention and, together with the general description given above and the detailed description of the embodiments given below, serve to explain the principles of the present invention.

DETAILED DESCRIPTION OF THE PREFERRED EMBODIMENTS

Figure 1:
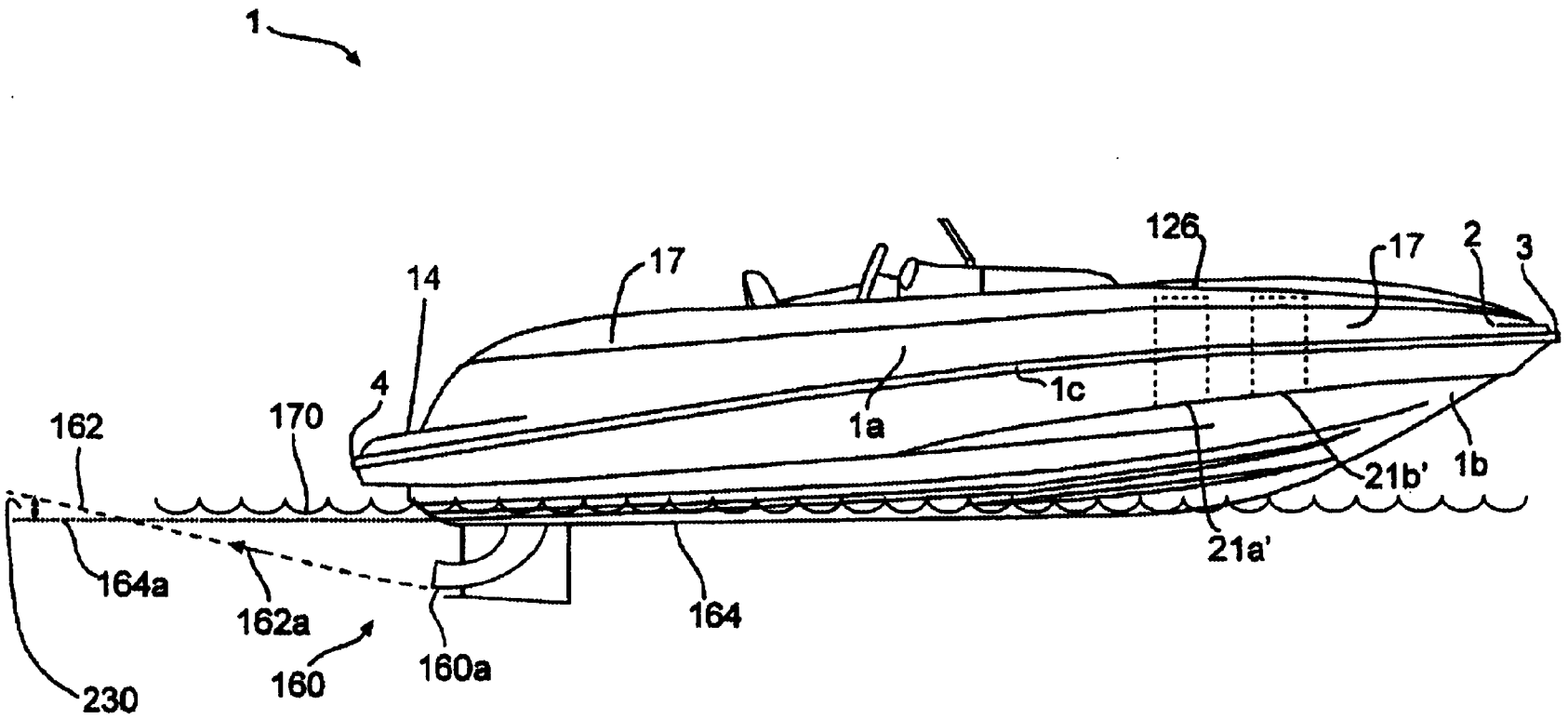
FIG. 1 is a side view of the deck boat of the present invention.

FIG. 1 is a side view of the deck boat (1) of the present invention. Deck boat (1) includes a bow (3), a stern (4), an upper hull (1*a*), and a lower hull (1*b*). Formed integrally with the upper hull (1*a*) is a front deck platform (2). The front deck platform (2) and upper hull (1*a*) are molded together as a single unit and sit above the water line (170). The upper hull (1*a*) and the lower hull (1*b*) are molded separately from one another and are sealed together at a seam (1*c*) in a manner known to those skilled in the art. The front deck platform (2) is positioned at the bow (3) and is generally flat in contour. The front deck platform (2) permits entry into and exit from the water. It also permits persons to board the boat (1) from a dock or from land, such as a beach. The front deck platform (2) also accommodates passenger seating and/or sunbathing.

In an exemplary embodiment, the deck boat (1) of the present invention may be powered by a jet drive system (160). Although most deck boats are propeller driven, the jet drive system (160) of the present invention provides for a faster, safer, and more responsive boat ride than can be experienced in conventional deck boats. Also, because they do not include externally-mounted propellers, jet drives (160) are considered to offer increased safety because they eliminate propeller-related injuries.

Figure 25:
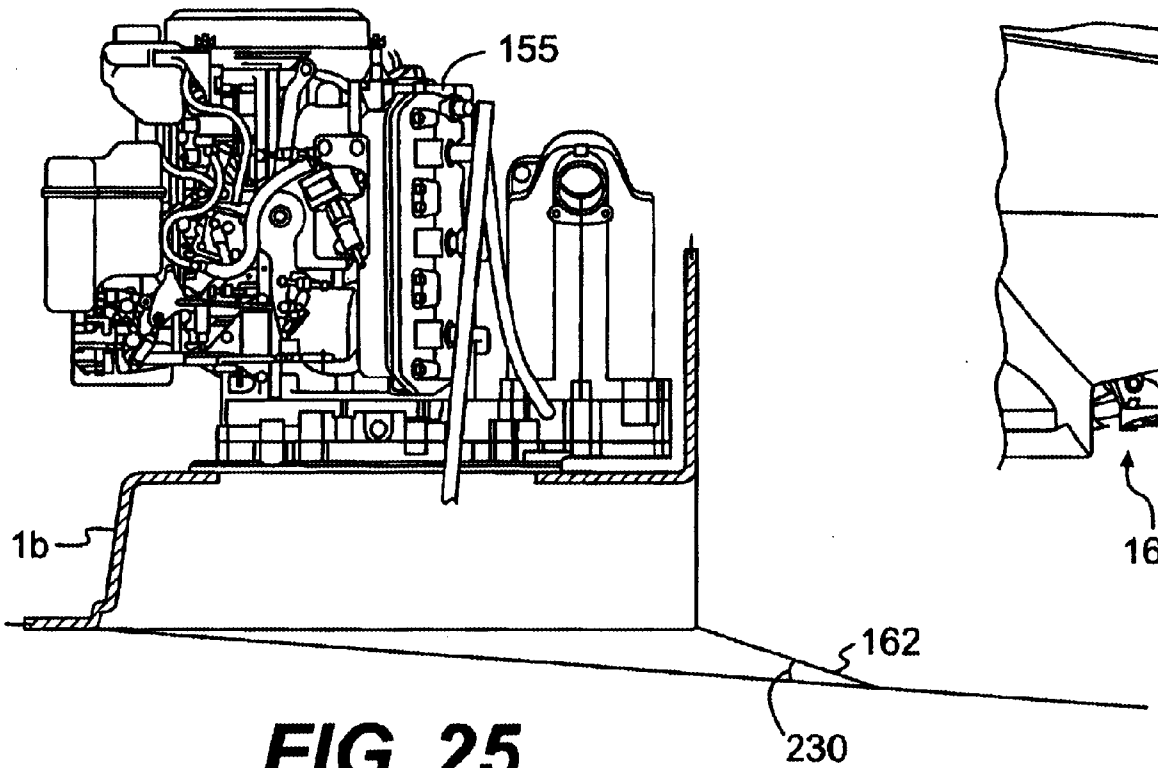
FIG. 25 is a cross-sectional view of the rear section of the deck boat of the present invention, which illustrates the angular relationship between the drive line and the keel line.

As shown in very general detail in FIG. 1, the jet drive system (160) includes, for example, a two-stroke or four-stroke inboard engine. Operating beneath the waterline (170) of the boat, a jet port (160*a*) of the jet drive system (160) generates force along a drive line (162) and in a predetermined direction (162*a*). The predetermined direction (162*a*) is generally toward the water's surface. A keel (164) of the boat, representing its lower centerline surface, forms a plane (164*a*) along the keel (164). The drive line (162) bisects the plane of the keel (164*a*) when the drive system (160) operates. Reference is also made to FIG. 25, which provides a more detailed illustration of some of these parameters.

In conventional jet drive systems, the drive line (162) bisects the plane of the keel (164) at an angle (230) of about 4 degrees. At this angle, and at certain speeds, a phenomenon known as "porpoising" can be detected by occupants of the boat. "Porpoising" refers to a condition where the boat tends to move up and down in the water like the movement of a porpoise when it jumps out of the water. However, by decreasing this angle (230) to less than 4 degrees, the effects of porpoising can be reduced. As illustrated in FIG. 25, the angle (230) has been reduced to 3.8 degrees. If the angle (230) is reduced still further, preferably to about 2 degrees or less, the effects of porpoising can be minimized even more, thereby providing for a more stable boat ride.

Also seen in FIG. 1, but discussed in greater detail later, is rear deck (14) located at the stern (4). A front character line (126) is shown, which defines a top section of the upper hull (1*a*). The front character line (126) also defines the top portions of seat backs (21*a*') and (21*b*'), which are positioned near a gunwale (17).

Figure 2:
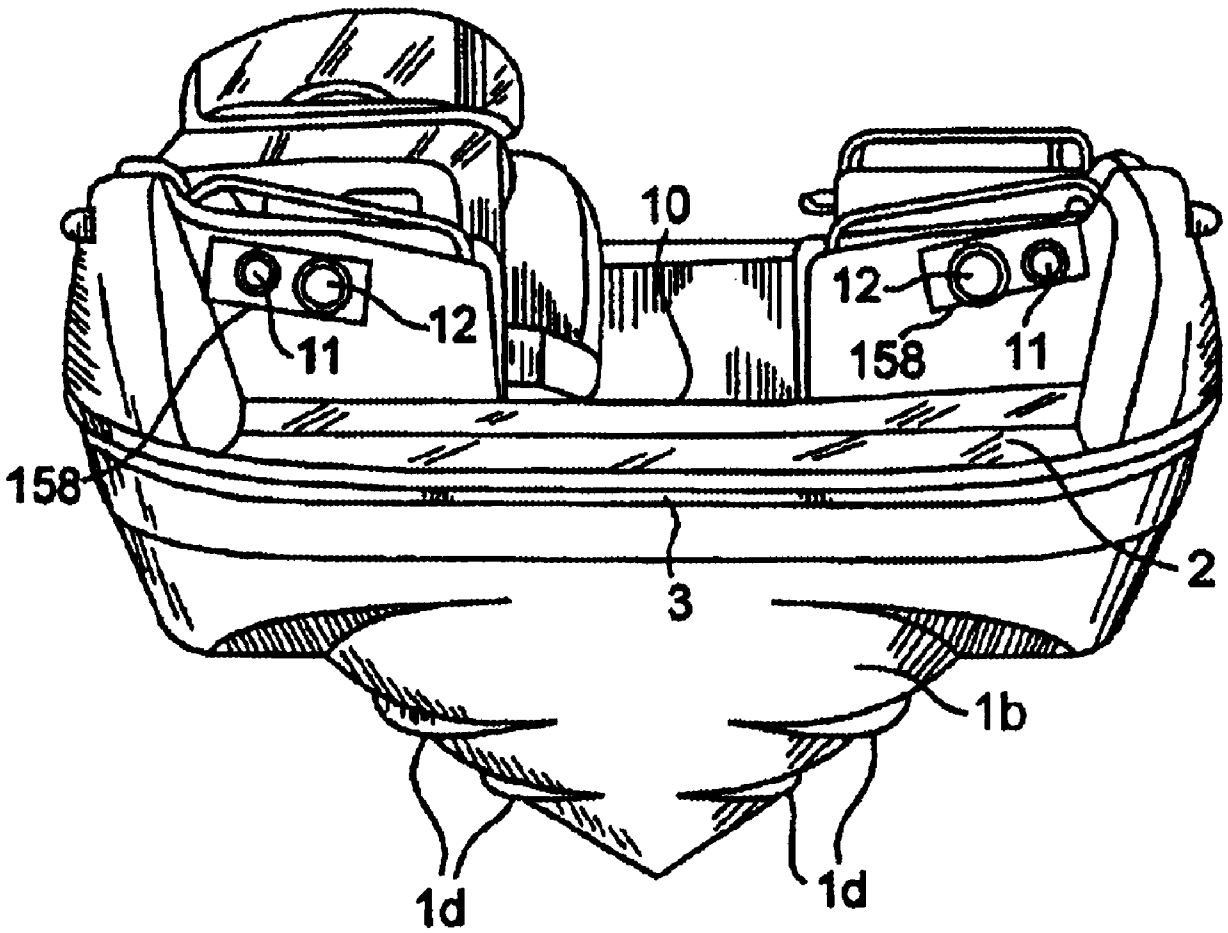
FIG. 2 is a front view of the deck boat of the present invention.

FIG. 2 illustrates a front view of an exemplary deck boat (1) in accordance with the present invention. The lower hull (1*b*) has a substantially V-shaped bow (3) and typical lifting strakes (1*d*). The front deck platform (2) includes a passageway (10) that permits entry into the interior of the deck boat (1) from the front deck platform (2).

Also seen from the front illustration are exterior lighting fixtures (158). Each fixture (158) includes, for example, a courtesy light (11) and a docking light (12) for illuminating the deck and other forward areas of the deck boat (1). The courtesy light (11) is structurally integrated with the docking light (12). That is, each lighting fixture (158) is made as a single, unitary construction (with two lights in each). Since the lighting fixtures (158) are made as integrated units, the construction, wiring harnesses, and installation are greatly simplified. As pre-assembled units, the lighting fixtures (158) of the present invention are assembled separately from the craft and are easily installed. The two lights are physically separate but contained behind or within a simplified housing or valance.

Figure 3:
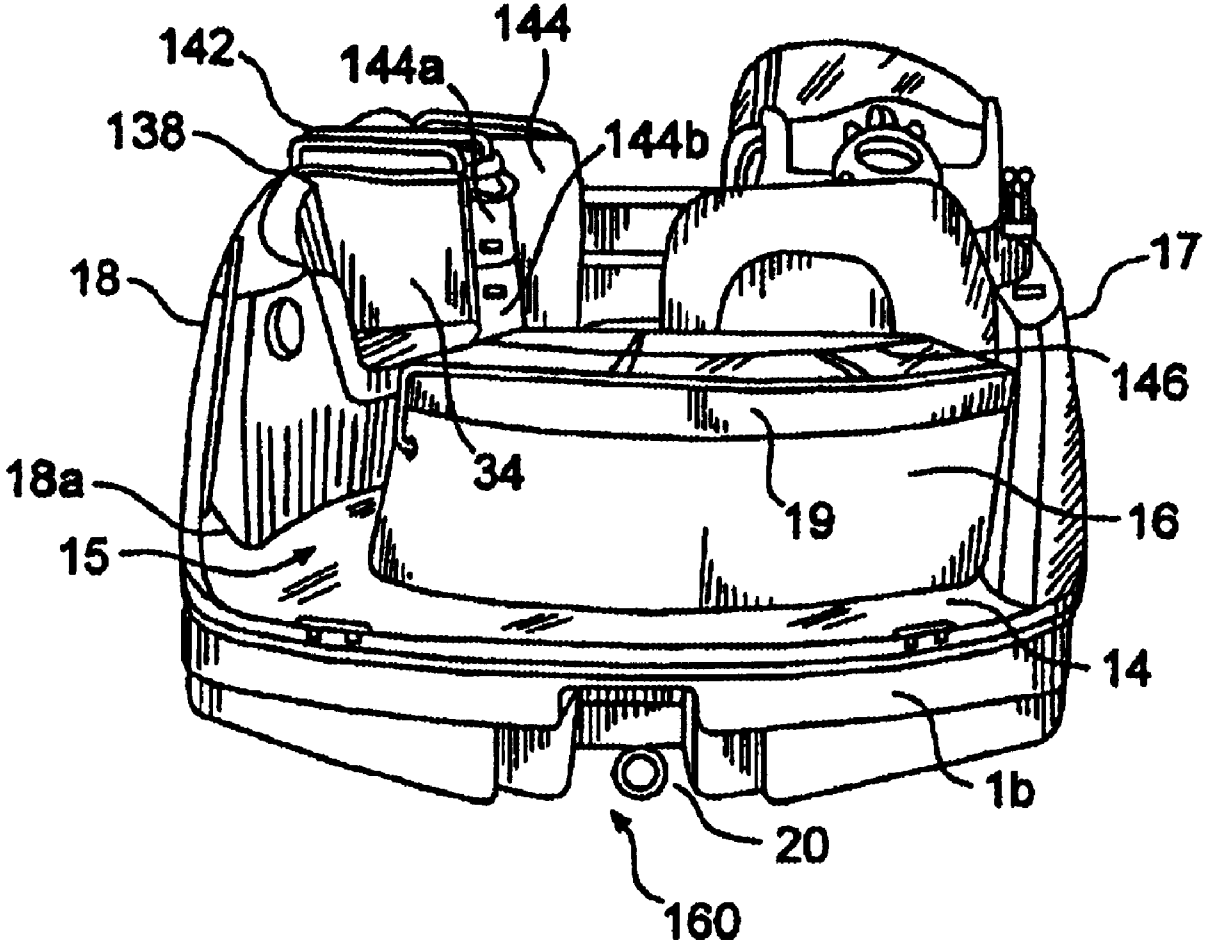
FIG. 3 is a rear view of the deck boat of the present invention.

FIG. 3 presents a rear view of deck boat (1) of the present invention. A jet drive tunnel (20) is integrally formed with the lower hull (1*b*) and provided at the rear of the boat for housing the jet drive system (160). Immediately above the lower hull (1*b*) at the rear of the boat is a rear deck (14).

The rear deck (14), which is integrated with the upper hull (1*a*), is provided to facilitate entry onto the boat from aft locations, such as from the water, a dock, or a beach. Thus, one can board the boat not only from the front, as illustrated in FIG. 2, but also from the rear onto the rear deck (14). Alternatively, one could board the boat through a left rear side access/boarding entranceway (15). The rear deck (14) and the left rear side access/boarding entranceway (15) are especially useful for boarding when the boat is docked.

Also illustrated in FIG. 3 is a rear view of gunwales (17) and (18), which form the side portions of the boat. Gunwales (17) and (18) define the dimensions of the rear deck (14) and the entranceway (15). Gunwales (17) and (18) are constructed to be of different lengths. As illustrated, for the preferred embodiment of the deck boat (1) of the present invention, gunwale (18), located on an opposite side of the boat to a driver's side, is shorter than gunwale (17), located on the driver's side. That is, gunwale (18) does not extend all the way to the rear of the boat on the port side, as illustrated by the termination point (18*a*) of gunwale (18). Thus, the shorter gunwale (18) facilitates construction of entranceway (15), which simplifies passenger loading and unloading from the port side of the deck boat (1). Additionally, placement of the shorter gunwale on the non-driver side of the boat (or the passenger side of the craft) allows free and unobstructed movement of people on the deck area, which is especially helpful when the vessel is docking. By placing the passenger access on the side of the boat opposite the driver, the person assisting in docking the craft will not obstruct the view of the driver or interfere with the driver's ability to safely dock the boat.

Figure 4:
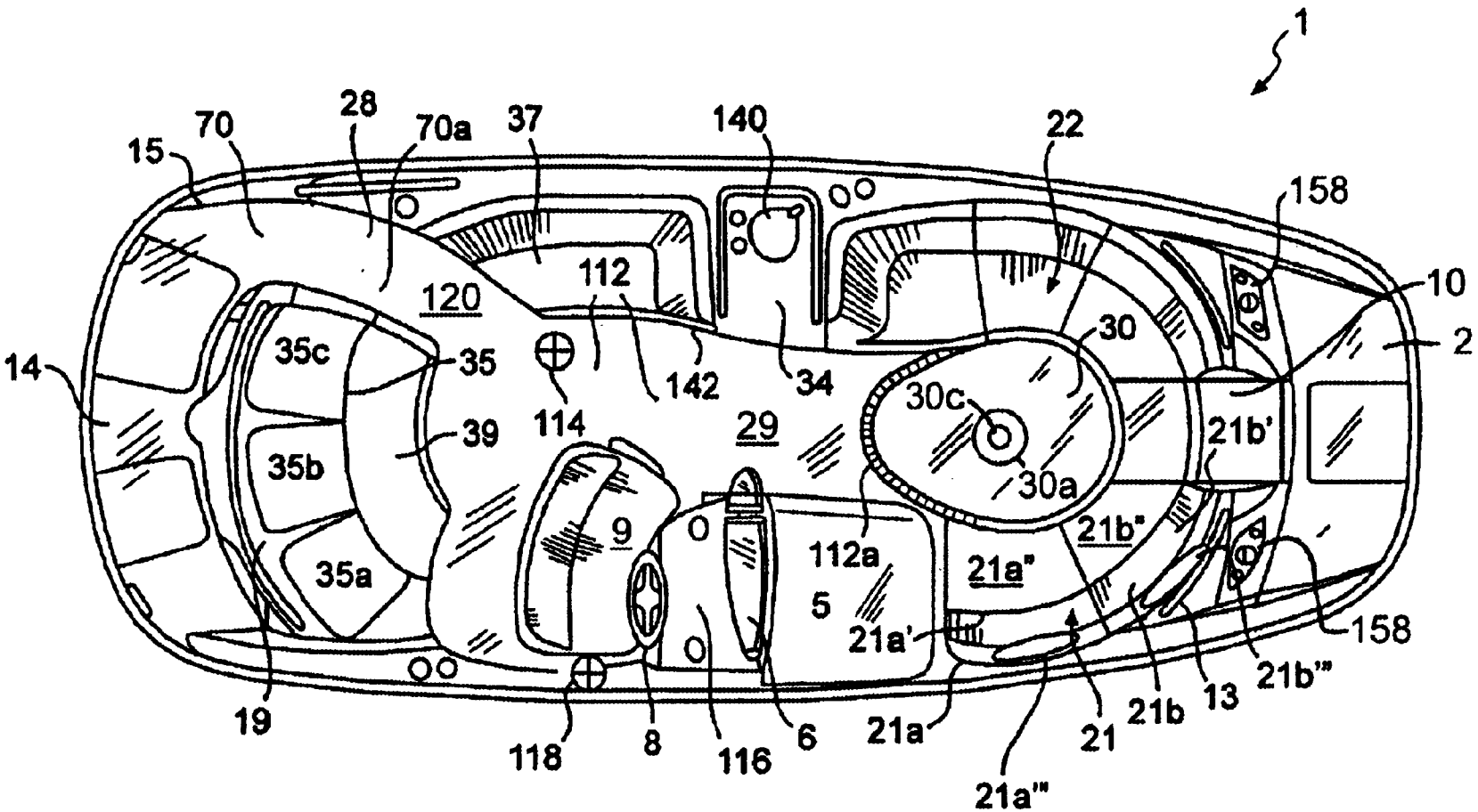
FIG. 4 is a top view of the deck layout of the deck boat of the present invention.

A galley module (34) is also shown in FIG. 3. The galley module (34) includes a counter (138) on which cooking elements or a sink (140), shown in FIG. 4, are installed in the preferred embodiment of the deck boat (1) of the present invention. A lower storage compartment (144) is provided in the galley module (34). The lower storage compartment (144) includes, for example drawers (144*a*) and (144*b*), in which utensils or an ice chest may be placed.

In the preferred embodiment, the galley module (34) is integrally formed as part of the upper hull (1*a*) and the counter (138) is separately constructed. In other words, the counter (138) is not molded as a part of the hull (1*a*). Instead, it is manufactured separately from the upper hull (1*a*) and is bolted onto the galley module (34) during assembly of the deck boat (1). While the galley module (34) preferably is molded as an integral part of the upper hull (1*a*), those skilled in the art would readily appreciate that the galley module (34) could also be constructed as a separate unit and fastened to the upper hull (1*a*). Side rails (142), located on the counter (138), can be used to fasten the counter (138) to the galley module (34). Side rails (142) may also be used as safety rails to prevent pots, pans, or other galley-related items from sliding off during movement of the deck boat (1). Since the countertop (138) is not molded as a part of galley module (34), it can be made from a typical countertop material such as stainless steel or some other commercial-grade countertop material such as Corian®. Although the exemplary embodiment of FIGS. 3 and 4 present the galley (34) opposite to a driver's side of the deck boat (1), the galley module (34) could be located in any other suitable location, as would be understood by those skilled in the art.

Finally, FIG. 3 also shows a motor compartment canopy (16), which is discussed in greater detail in connection with FIGS. 19–21. A sun deck (19), which has a substantially flat surface (146), is formed on the upper surface of the motor compartment canopy (16).

As shown in FIG. 4, sun deck (19) includes a front section (39) and a rear section (35). When desired, front section (39) and rear section (35), each of which are provided with cushions, can be configured to form the substantially flat surface (146) seen in FIG. 3. When the front section (39) and rear section (35) are configured to present a flat surface (146), passengers may lay down on that surface (146) and sun bathe, for example. Alternatively, supporting members (35*a*, 35*b*, and 35*c*) of rear section (35) can be angled to form seats with the front section (39) so that passengers may sit comfortably on the sun deck (19) in an upright position.

Figure 5:
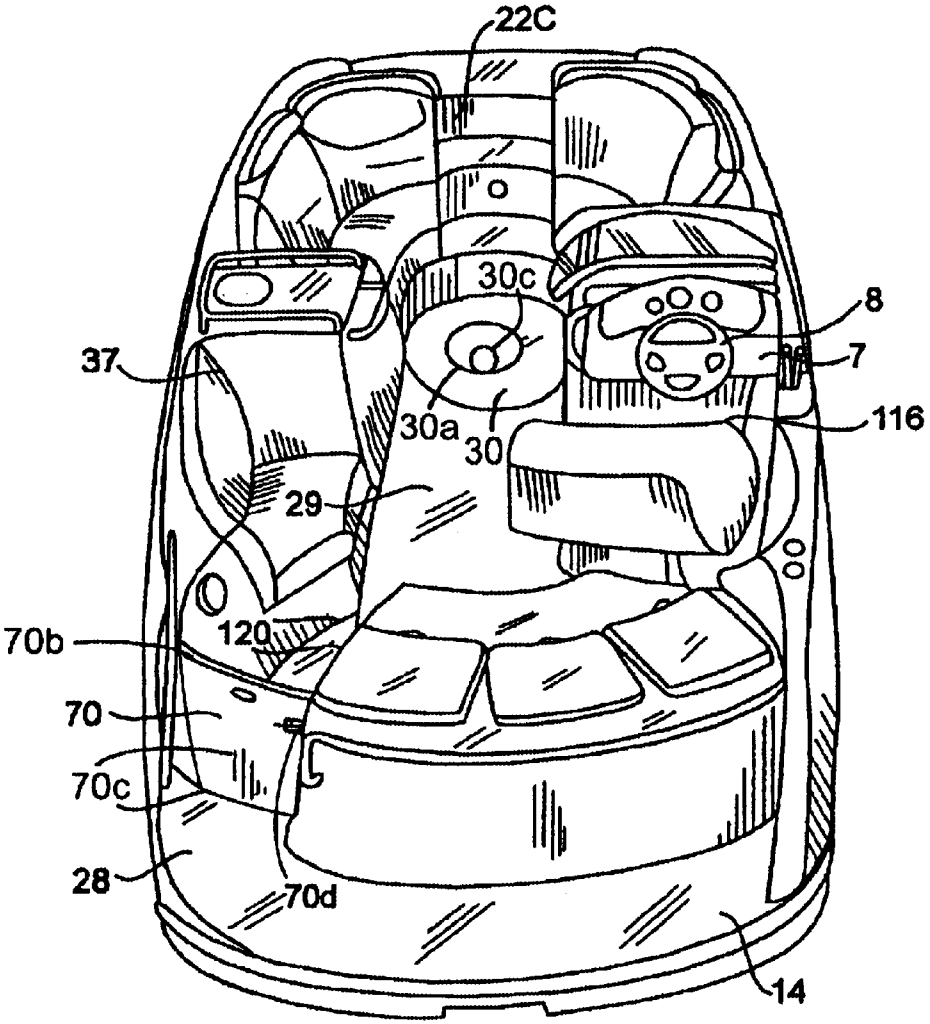
FIG. 5 is a rear perspective view of the deck layout of the deck boat of the present invention.
Figure 6:
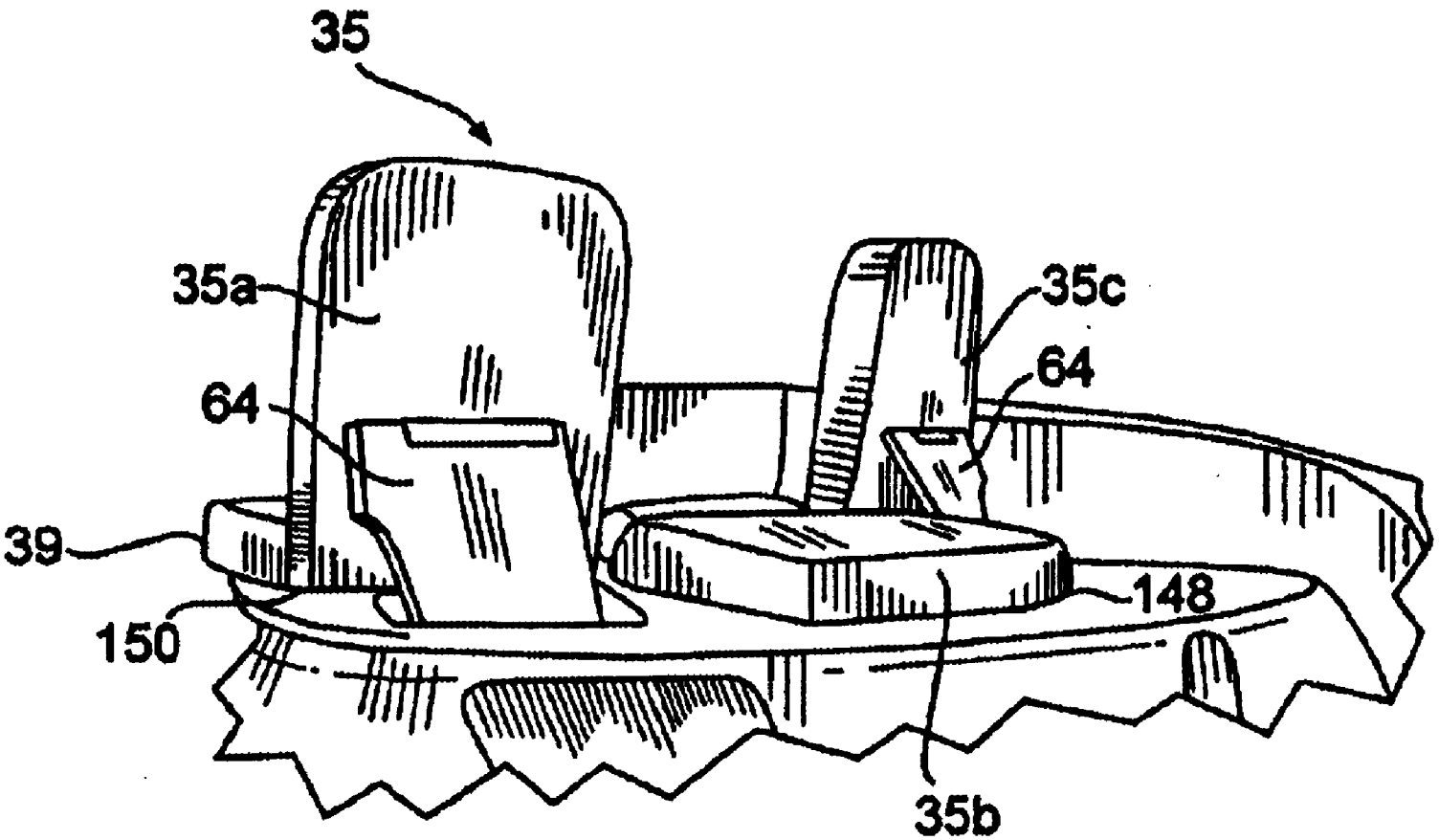
FIG. 6 is a partial rear perspective view of the deck boat of the present invention, showing the seat backs in a generally upright position.

As illustrated in FIGS. 4–6, the rear section (35) is formed of a number of individual supporting members (35*a*–35*c*), each of which can be separately oriented in a first lowered position (148). Supporting member (35*b*) is shown in such a position in FIG. 6. Also as shown in FIG. 6, supporting members (35*a*–35*c*) can be oriented to at least one second raised position (150). When moved to the second raised position (150), the supporting members (35*a*) and (35*c*) are locked into place using locking mechanisms (64), which are typical for this construction, as would be known to those skilled in the art. While only three supporting members (35*a*–35*c*) are illustrated, it should be noted that a fewer number or a greater number of supporting members could be provided at the rear section (35) of sun deck (19).

Referring again to FIG. 4, a pool area (30) is preferably positioned in a front section of the deck boat (1). The pool area (30) can be used for passengers to cool off by submersing their feet in the pool (30), once filled or, it may serve as an amusement attraction for small children. Alternatively, the pool (30) may serve as a live bait area to be used by fishermen. The pool (30) is formed by a 4–5 inch recess or depression in the surface (112*a*) of the central deck (29) of the deck boat (1).

Figure 7:
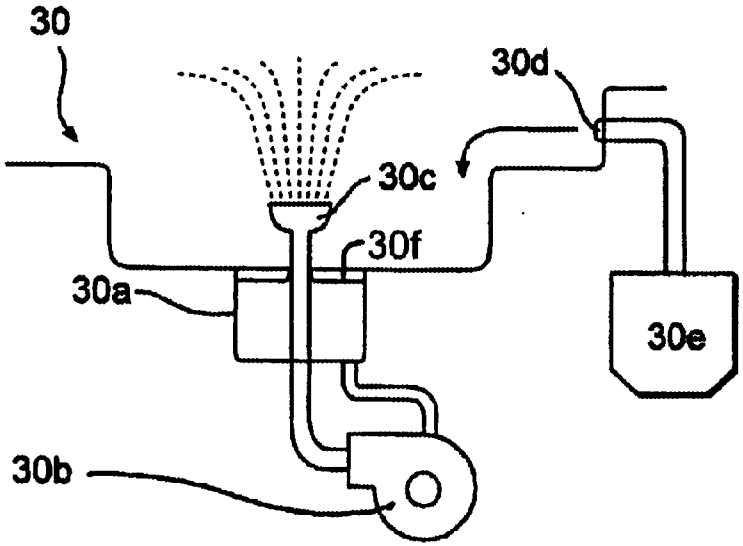
FIG. 7 is a schematic of the pool area and associated equipment for the deck boat of the present invention.

Referring now to FIG. 7, a sump (30*a*) is provided at the bottom of the pool (30) to act as a drain to collect the water in the pool (30). A pump (30*b*) is connected to the bottom of the sump (30*a*) to drain the pool (30) or to provide water in the pool (30) to a fountain (30*c*), if the craft is so equipped. When installed, the fountain (30*c*) preferably is incorporated into the sump (30*a*) beneath the pool area (30) to spray water into the air. A sump lid (30*f*) is provided to cover the sump (30*a*).

While the fountain (30*c*) is shown in connection with the pool (30), those skilled in the art will readily recognize that a pool area (30) is not required for operation of a fountain. While not preferred, it is possible that a fountain may operate on the deck boat (1) without being positioned in a pool area (30). For example, a fountain could be provided for people relaxing in the forward deck area for purposes such as cooling off. Alternatively, water could be provided not only to the pool (30), but could be distributed to other areas the deck boat (1) through a faucet (30*d*) connected in the vicinity of the pool (30), that receives a water supply from a reservoir (30*e*). A hose also could be connected to the faucet (30*d*) to clean deck areas on the boat (1).

The fountain (30*c*) could be designed to spray the water in a number of different ways. For example, it could be designed to project a single column of water several feet into the air, or may be adjusted to create a shower-like spray (having multiple streams (as shown in FIG. 7). Finally, it may be adjusted to spray a fine mist into the forward deck area (29) to cool the passengers seated therein.

Referring again to FIG. 4, a mister (118) may be placed in a cockpit area (116) of the deck boat (1), or any other suitable location. The cockpit area (116) is the location from which the driver controls the deck boat (1). The mister (118) may be used to cool off the people in the cockpit area (116) and other areas of the deck boat (1), such as the pool area (30), where the mister (118) may be preferred. Similarly, a shower (114) may be placed at a rear section of the deck boat (1) for a variety of purposes, including use as another shower or for spraying or washing off areas of a main deck (112) or as a shower for passengers. The shower (114) may be a nozzle and hose connected to a water tank (30*e*) on deck boat (1). The shower (114) may be concealed easily behind a cover panel when not in use. The shower (114) may be positioned at any suitable location on the deck boat (1) and is not limited solely to the location indicated.

FIG. 4 also illustrates the two forward seating areas (21) and (22). Each seating area (21) and (22) preferably includes a number of passenger seats, for example seats (21*a*) and (21*b*) of seating area (21), for accommodating multiple passengers. In the preferred embodiment, seats (21*a*) and (21*b*) are constructed to have seat backs (21*a*') and (21*b*') and corresponding seat bottoms (21*a*") and (21*b*"). Seat backs (21*a*') and (21*b*') are taller that conventional seat backs of traditional deck boats. The height of the seat backs (21*a*') and (21*b*') has been raised to extend above the front character line (126), which is illustrated in FIG. 1. The increased height of the seat backs (21*a*') and (21*b*') provides increased back support and comfort. In addition, it is believed that the taller seat backs (21*a*') and (21*b*') may have an additional safety function (by comparison with prior art designs) because of the added height to the sides of the deck boat (1). In conventional deck boats, the front character line is the same level as the top of an associated gunwale. However, in the present invention (as shown in FIG. 1), the gunwales (17) and (18) are extended well above the front character line (126) to facilitate placement of taller seatbacks (21*a*') and (21*b*') in deck boat (1). An additional advantage of the extended height of gunwales (17) and (18) is that adjustable head rests (21*a*'") and 21(*b*'") can be added to the seatbacks.

Further, the seat bottoms (21*a*") and (21*b*") of seating areas (21) and (22) are positioned lower than conventional deck boats. In the preferred embodiment of the present invention, seat bottoms (21*a*") and (21*b*") are positioned vertically lower than conventional designs by approximately 4–5 inches. With the seating areas (21) and (22) so configured, a driver of the deck boat (1) can see over the heads of passengers seated in the respective seating areas (21) and (22) while operating the deck boat (1).

Figure 8:
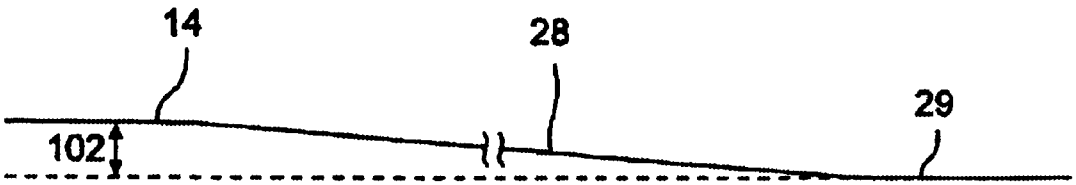
FIG. 8 is a schematic side view of the gradient of the ramp area disposed between two of the deck surfaces on the deck boat of the present invention.

As shown in FIGS. 4 and 5, a ramp area (28) connects the rear deck (14) and rear entranceway (15) to the central deck (29). The ramp area (28) has a slight gradient (102), which is illustrated in FIG. 8. The gradient (102) slopes downward from the rear deck (14) to the central deck (29). The ramp area (28), although substantially flat, includes a gradient (102) that provides a vertical drop of approximately 2 inches, as seen in FIG. 8. In accordance with the present invention, the ramp area (28) is considered to be safer than conventional designs because it provides a graduated transition from the rear deck (14) to the central deck (29) and vice versa. In conventional boat designs, a step is provided from the rear deck down into the central deck area. The ramped area of the present invention provides a smoother, and thus, potentially a safer transition from one deck to another.

As shown in FIG. 5, the ramp area (28) is positioned within a curved or angled entry area (120) into the deck boat (1). The curved entry area (120) permits the construction of a boat that has both a side seat (37) forward of the curved entry area (120) and a rear sundeck (19). In other words, the curved entry area (120) permits maximization of the seating on the deck boat (1). As discussed above, the curved entry area (120) has a gradient (102) that is angled slightly downward to provide a step-less approach to the passenger area at the rear of deck boat (1).

Referring to FIGS. 4 and FIG. 5, a retractable door (70) is provided in curved entry area (120) to separate the central deck (29) from the rear deck (14). The door is selectively changeable between a first open position (70*a*) and a second closed position (70*b*). In the open position (70*a*), the door (70) retracts into the side of one of the seating areas (19) or (37) at the rear of the deck boat (1). When retracted, the door (70) is flush with the exterior surface of one of the seating areas (19) or (37) and may be securely fastened using a locking mechanism (70*d*). When in the closed position (70*b*), the retractable door (70) minimizes the ingress of water from the rear of the craft when the craft is moving or when it stops. It also shields the rear portion of the boat from the wind, and provides a barrier for small objects. Also, the retractable door (70) is provided with a seal (70*c*) around its outer edges to seal with the sides of the passageway and the ramp area (28) to prevent the ingress of water into deck boat (1).

FIG. 5 illustrates the cockpit area (116) of deck boat (1), which includes a steering wheel (8) and a steering console (7). The steering console (7), which houses steering wheel (8), is formed of a single unitary construction and then fastened to the upper hull (1*a*). The steering console (7) is designed in this manner so that the steering wheel (8) and steering console (7) can be manufactured separately from the deck boat (1) and upper hull (1*a*).

To simplify construction of the deck boat (1), the console (7) can be assembled with any required instrumentation and then affixed to the deck boat (1) as an integrated unit. The console (7) is fastened along its forward edge as well as along its outboard side to the upper hull (1*a*). This greatly increases the rigidity and strength of both the deck and the console (7). Moreover, this combined construction process is more reliable and provides a more rigid steering console than if the console were molded with the upper hull (1*a*), as is done in conventional boats. Also, since the console (7) is not molded with the upper hull (1*a*), it can be shaped in a number of unique ways because the console shape does not interfere with the releasability of the upper hull (1*a*) from its associated forming mold.

Figure 9:
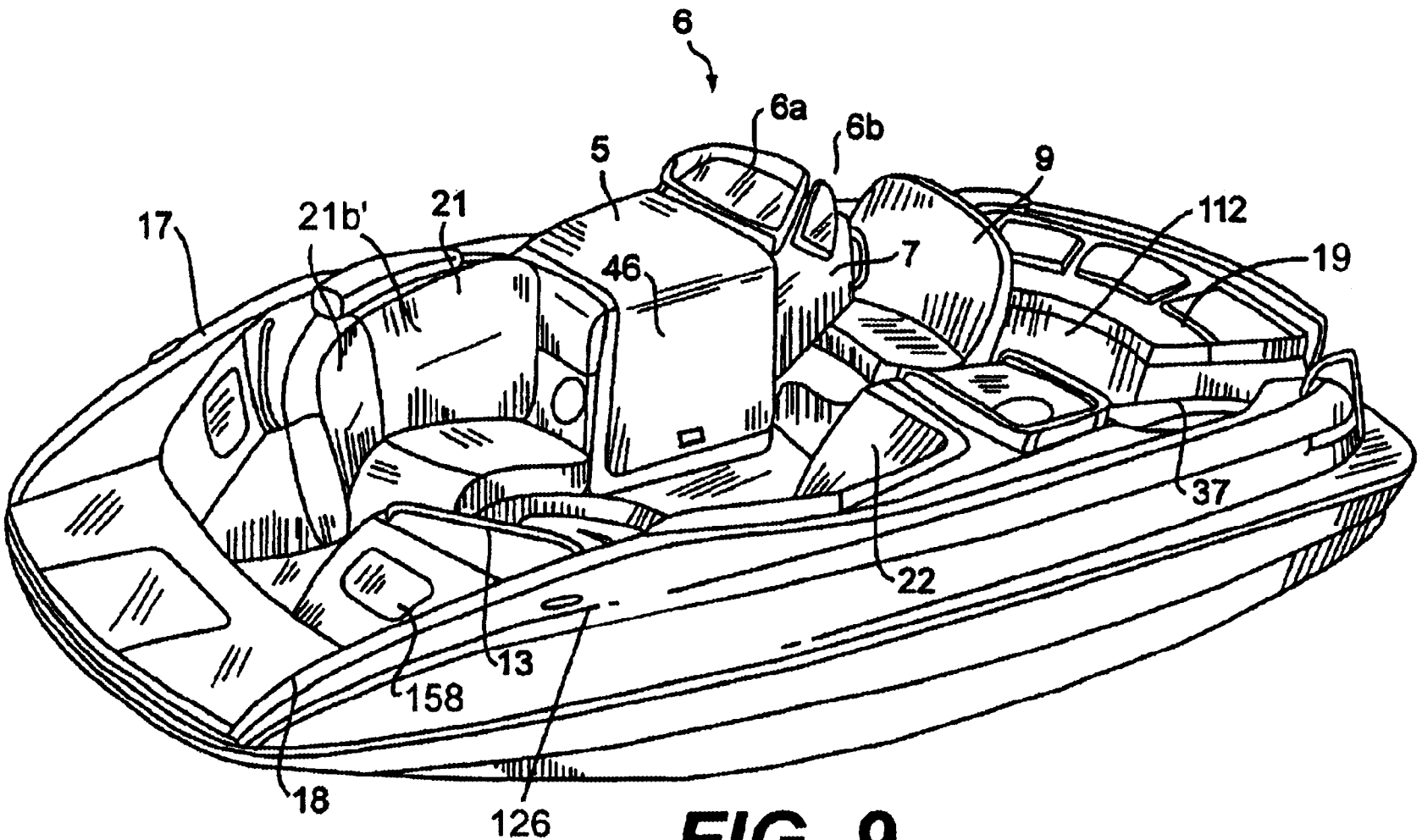
FIG. 9 is a port side perspective view of the deck boat of the present invention.

FIG. 9 illustrates the windshield assembly (6) of the present invention and its attachment to the steering console (7). Preferably, the windshield (6) includes two parts (6*a*) and (6*b*) that are articulated with respect to one another, for example by a hinge 6*c* (FIG. 21), so that a moveable part can be unfolded to extend into a passageway between the central deck area (112) and the front passenger area. The windshield (6) includes a main portion (6*a*) and may also include at least one separately adjustable windshield flap (6*b*). The main portion (6*a*) primarily acts as a windscreen for the driver of the deck boat (1), while the windshield flap (6*b*) acts as a windscreen for the person sitting in the left position of an adjustable driver's seat (9). It also acts as a windscreen for occupants at other areas of the deck boat (1). Alternatively, the windshield (6) may not include the flap (6*b*) but may be a single-piece construction.

Referring again to FIGS. 5 and 9, grab handles (13) have been added to the passenger seating areas (21), (22), and (37) to increase the number of places where passengers may hold onto the boat for additional safety and stability.

Figure 10A:
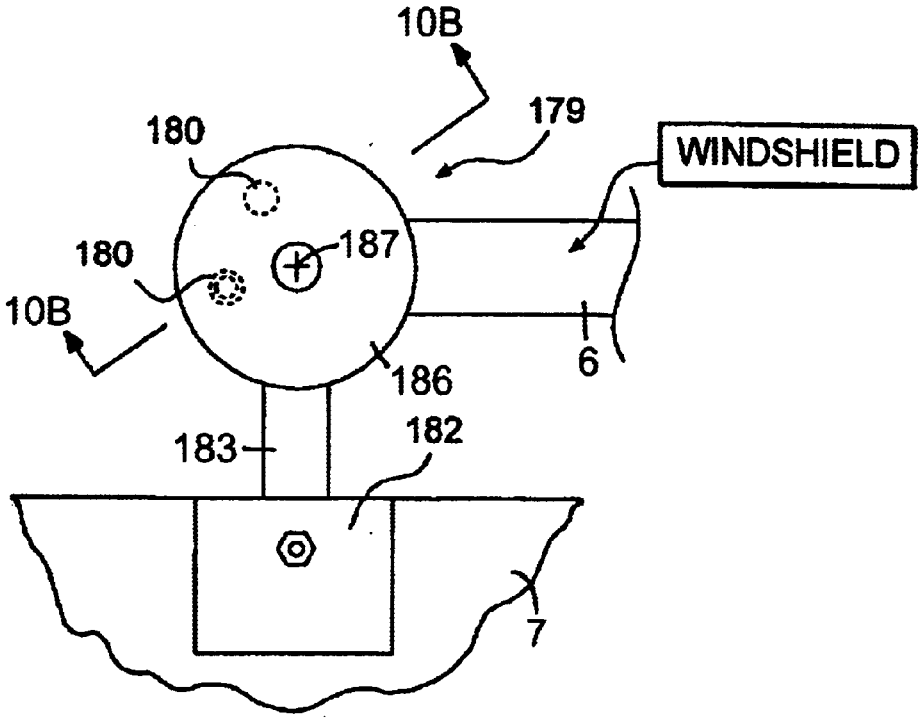
FIG. 10A is a side view of the window position locking mechanism.
Figure 10B:
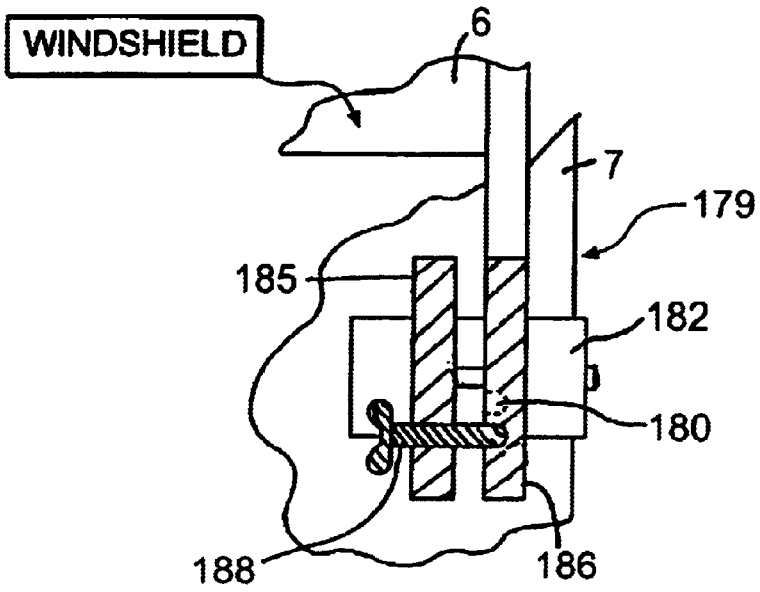
FIG. 10B is a partial cross-section of the window position locking mechanism taken along line 10B—10B in FIG. 10A.

FIGS. 10A and 10B illustrate one possible connection of the windshield (6) to the console (7). In this preferred embodiment, the windshield (6) may be positioned so that it stands upright or it may be positioned so that it lays down against the top surface of the console (7). To hold the windshield (6) in either position, an attachment mechanism (179) is affixed to the console (7).

The attachment mechanism (179) includes a bracket (182) that may be affixed by any suitable means to the upper surface of the console (7). The bracket (182) is connected to a brace (183) that extends upwardly from the bracket (182) and connects to a first disk (185). First disk (185) is pivotably connected to a second disk (186) along an axis (187). A threaded screw (188) is disposed through first disk (185) and engages a detent or hole (180) in the second disk (186) to hold the windshield (6) in place. While only two positions are shown in FIG. 10A for the detents (180) (which correspond to the upright position and the horizontal position for windshield (6)), those skilled in the art will readily recognize that any number of detents (180) may be provided in second disk (186) to provide any number of positions for windshield (6). Furthermore, any number of mechanisms may be substituted for attachment mechanism (179) while remaining within the scope of the present invention.

Referring again to FIG. 9, a cover (46) is shown for a privacy compartment (5) immediately in front of console (7). The privacy compartment (5) is a retractable compartment integrated into the hull (1*a*). In the preferred embodiment, the cover (46) is hingedly mounted to the upper hull (1*a*).

FIGS. 11–16 provide more detailed views of the privacy compartment (5). The privacy compartment (5) could be, for example, a toilet, shower, or changing area and is integrally formed with hull (1*a*). The privacy compartment (5) may be opened by lifting the cover (46) until it is upright. The cover (46) could be, for example, L-shaped in its cross section. When opened, the interior area is tall enough so that a person of average height can stand-up. In fact, it is preferred to provide 6 feet, 2 inches of headroom or more so that the privacy compartment (5) is not overly restrictive to the occupant. A tent-like structure (46*a*), constructed of a fabric, is provided in the open area of the privacy compartment (5) so that a person may use the toilet facility or may change his or her clothes in privacy. An acceptable fabric could be, for example, a canvas-type material.

Figure 11:
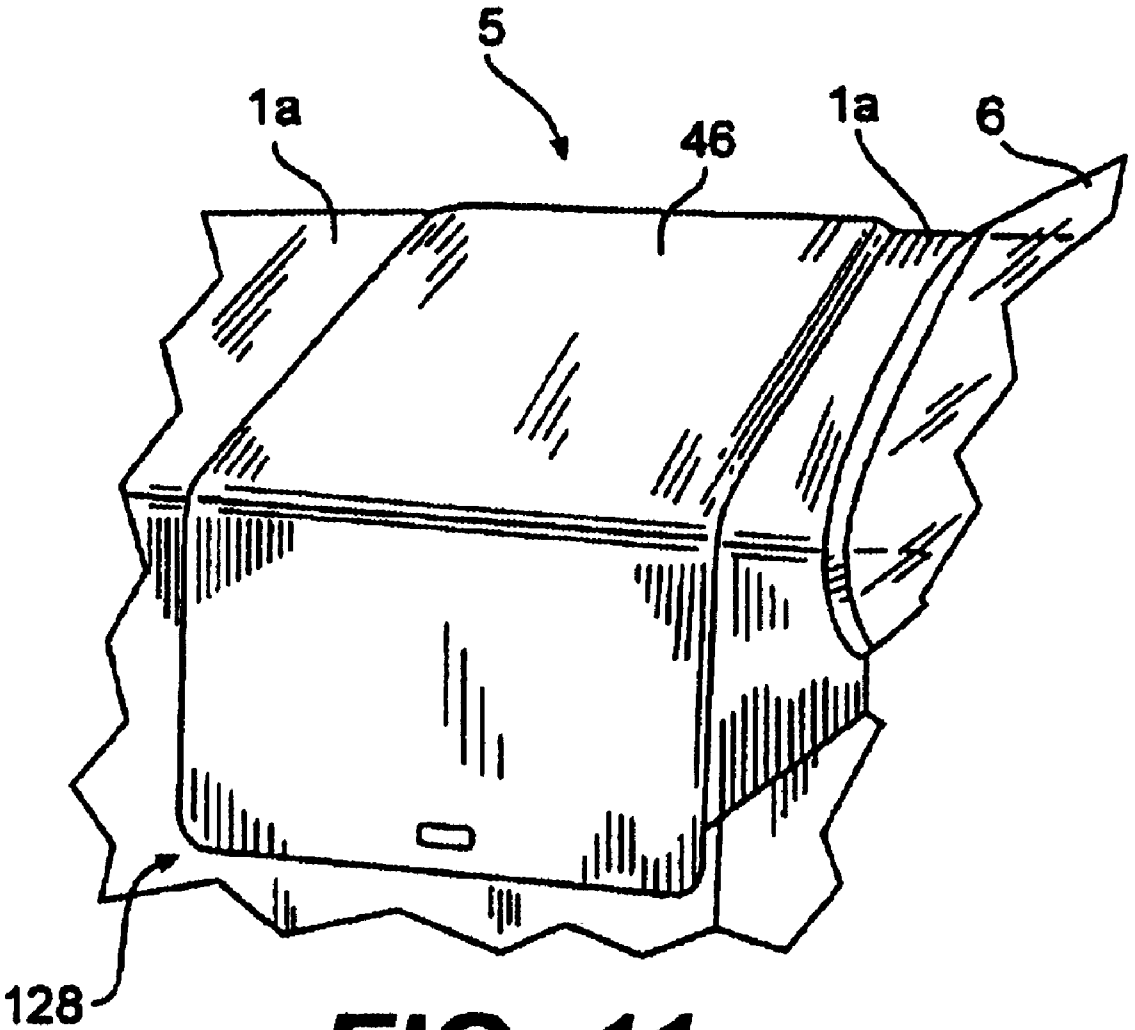
FIG. 11 is a partial perspective view of the privacy compartment in a closed position.
Figure 12:
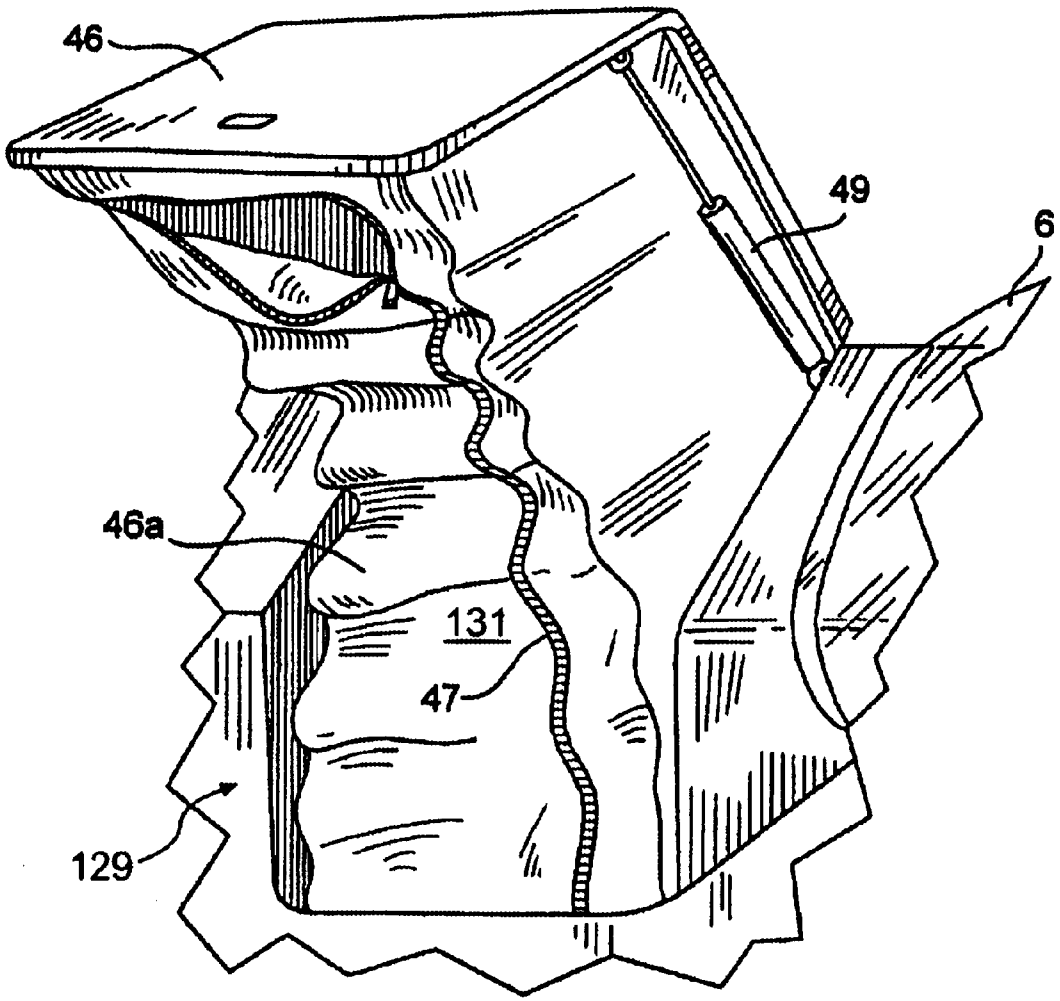
FIG. 12 is a partial perspective view of the privacy compartment in a half-open position.
Figure 13:
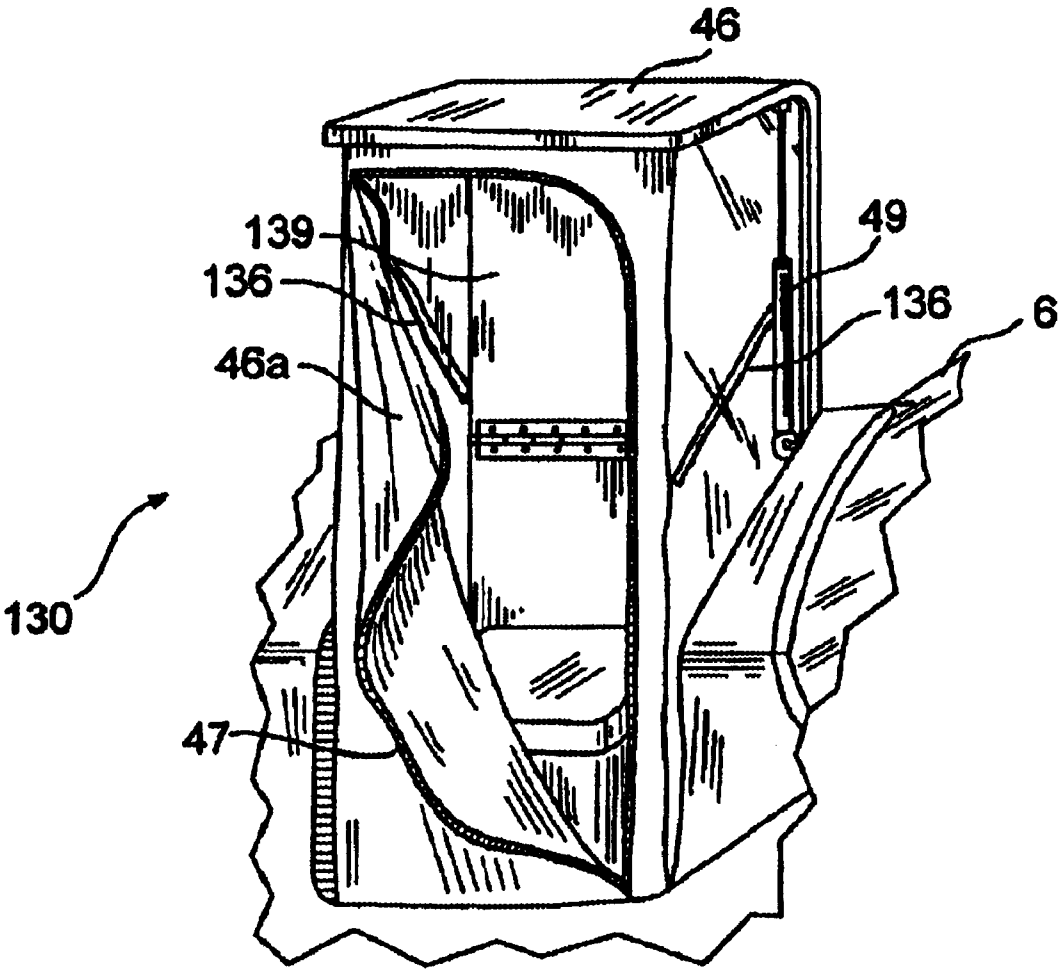
FIG. 13 is a partial perspective view of the privacy compartment in a fully deployed position.
Figure 15:
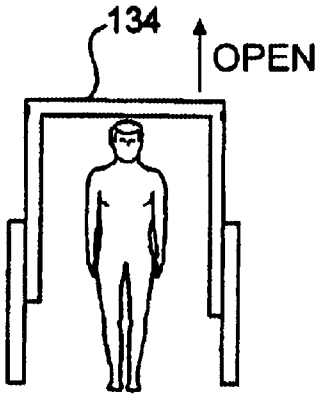
FIG. 15 is a view of a second alternative scheme for the privacy compartment.

FIGS. 11–13 illustrate the privacy compartment being selectively changed between a fully retracted position (128), shown in FIG. 11, and a fully deployed position (130), shown in FIG. 13.

In its compressed or retracted position (128), as shown in FIG. 11, the privacy compartment (5) is not useable, but blends into the decor of the deck boat (1). In this position, the driver can see easily thereover. The cover (46) is attached to the privacy compartment (5) cavity by means of hydraulic shocks (49), seen in FIG. 12, which are similar to those used on an automobile hood in an automobile, that provide support for the cover (46) when opened. Alternatively, the cover (46) may be held open by a prop rod (not shown) or other similar device. Also, FIG. 12 shows the cover (46) in a half-open position (129) with the tent-like structure (46*a*) visible. Also visible is a zipper (47) for securely fastening the entry and exit door (131) to the privacy compartment (5).

In FIG. 13, the cover (46) has been fully deployed upwardly and provides sufficient height within the compartment for an average sized adult to stand up. The tent (46*a*) is attached to the compartment cover (46) and extends downwardly when the privacy compartment is in the user position.

While the cover (46) can be opened manually, it is also possible that the door could be motorized so that it can be opened by a mechanical and/or electrical switch (not shown). The exemplary L-shaped cover (46) makes the compartment easily deployable. However, the door need not necessarily be L-shaped.

FIG. 13 also shows the position of battons (136), which are rigid cylindrical rods that are sewn into the fabric to prevent billowing of the fabric area when the cover (46) is being closed. The battons (136) permit the canvas fabric to fold easily without becoming caught between the cover (46) and the hull (1*a*), while the cover (46) is being closed.

In addition, a mesh fabric (139) is provided at the rear of the changing area. The mesh fabric (139) permits air to escape from the canvas tent (46*a*) when the L-shaped lid (46) is closed. The mesh fabric (139) also provides ventilation for the toilet/changing area.

Figure 14:
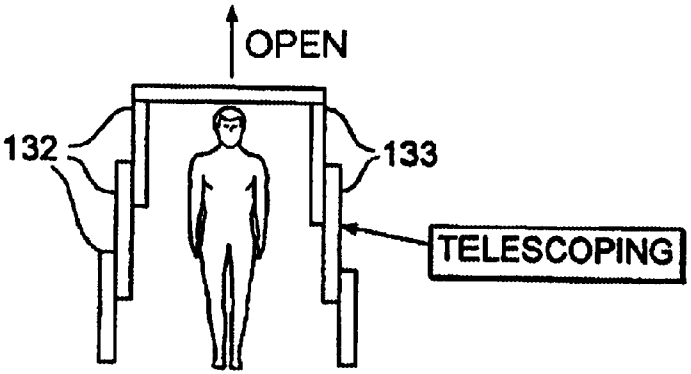
FIG. 14 is a view of a first alternative scheme for the privacy compartment.
Figure 16:
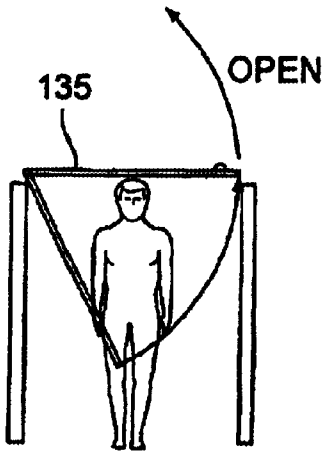
FIG. 16 is a view of a third alternative scheme for the privacy compartment.

As shown in FIG. 14, it is also possible that sides (132) and (133) of the privacy compartment (5) could telescope from the hull (1*a*) to create the compartment (5), as illustrated. In yet another embodiment, illustrated in FIG. 15, the top could be provided with a singularly constructed portion (134) like a bucket that extends upwardly from the closed position. In a third possible embodiment, the top of the privacy compartment could include a curved (or triangular) front wall (135) pivotally articulated to form the privacy area (5), as shown in FIG. 16.

Finally, while shown in a position forward of the cockpit area (116), it should be noted that the privacy compartment (5) may be placed in any suitable location on the deck boat (1).

Figure 17:
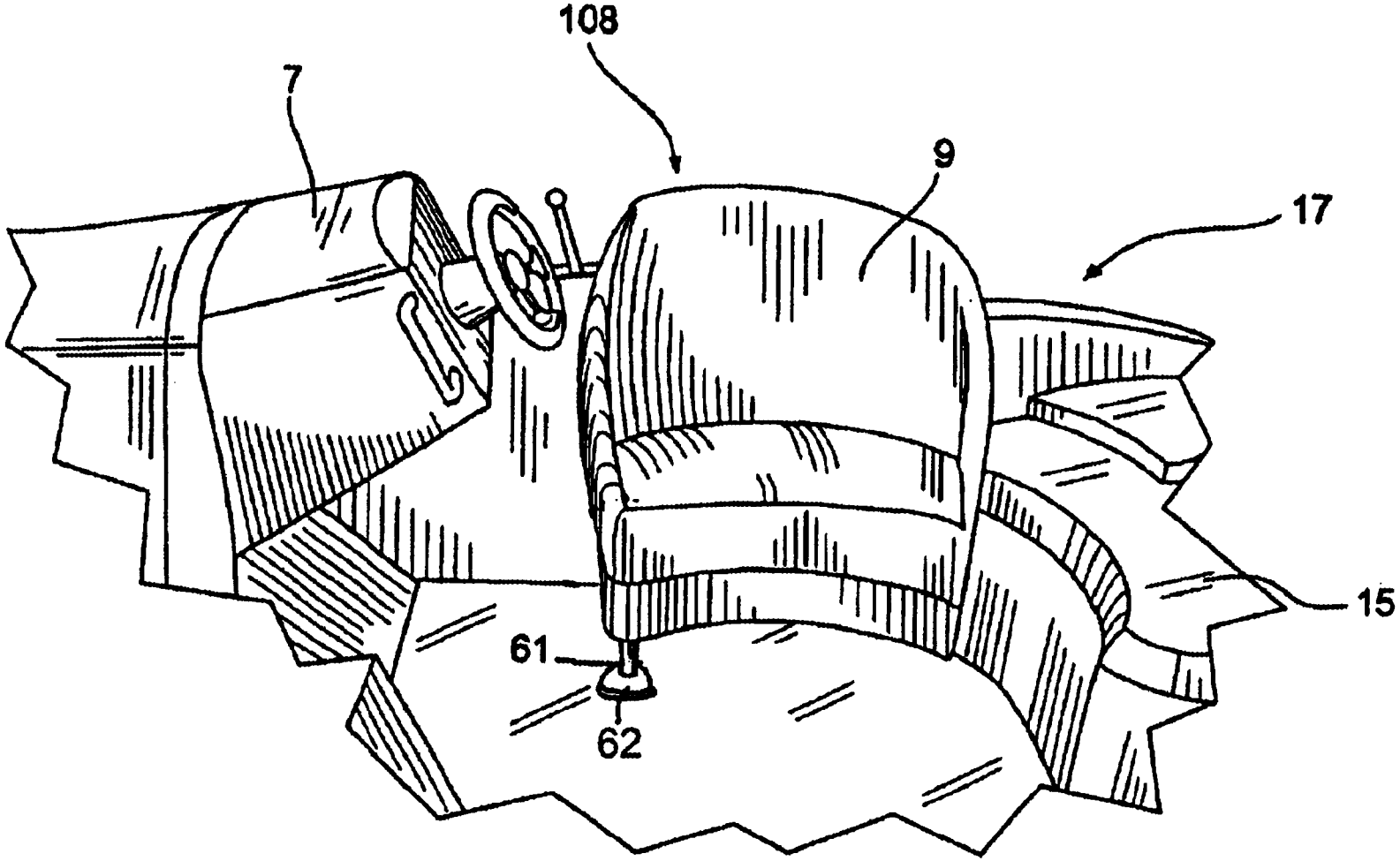
FIG. 17 is a partial perspective view of the driver's seat in a relaxing position.
Figure 18:
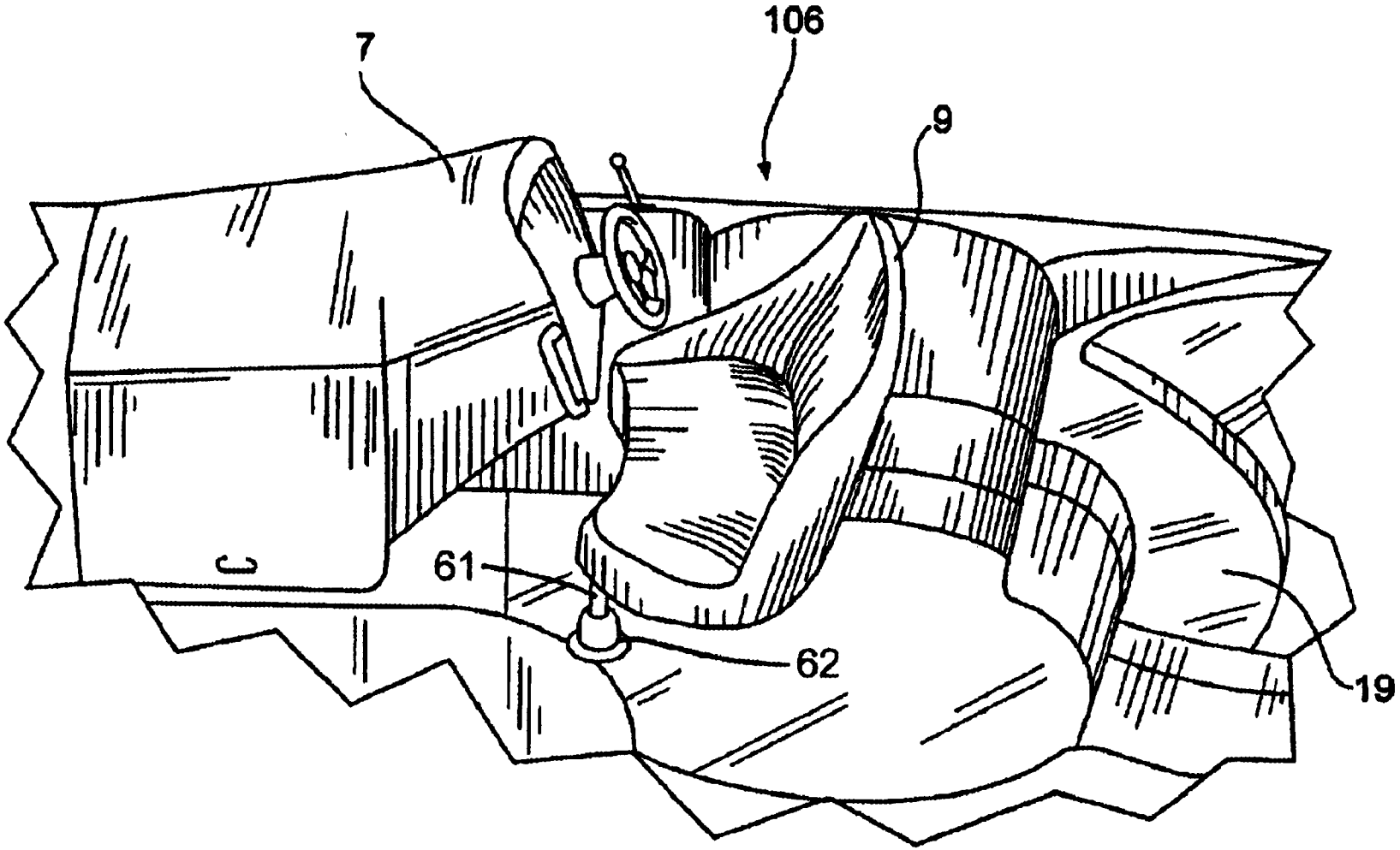
FIG. 18 is a partial perspective view of the driver's seat in the driving position.

FIGS. 17 and 18 present an exemplary embodiment of a reconfigurable driver's seat (9). The driver's seat (9) is sized so that it can accommodate a driver and at least one companion. For this reason, the seat (9) is referred to as a "buddy seat." As shown in FIG. 17, driver seat (9) can be rotated into a non-operating (relaxing) position (108) for conversation or party activities. To achieve this, the driver's seat (9) is rotated about a swivel mount (61) so that it can be retracted against the side gunwale of the deck boat (1) into the relaxing position (108). The driver's seat (9) is attached to the floor and is lockable in a driving position (106) on pedestal stop (62), seen in FIG. 18.

When in the retracted, or in the relaxing position (108), the driver's seat (9) connects with the sun deck (19) to create the single continuous seat from the entranceway (15) passage to the cockpit area (116). When in the driving position (106), the seat (9) orients a driver of the deck boat (1) in a proper position for driving and the seat (9) is again locked about pedestal (62).

Pedestal (62) may be of any construction suitable for permitting seat (9) to pivot from the relaxing position (108) to the driving position (106). Pedestal (62) may also be equipped with a slide mechanism (not shown) so that the driver may move seat (9) forwardly or rearwardly to accommodate his or her height and comfort requirements.

Figure 19:
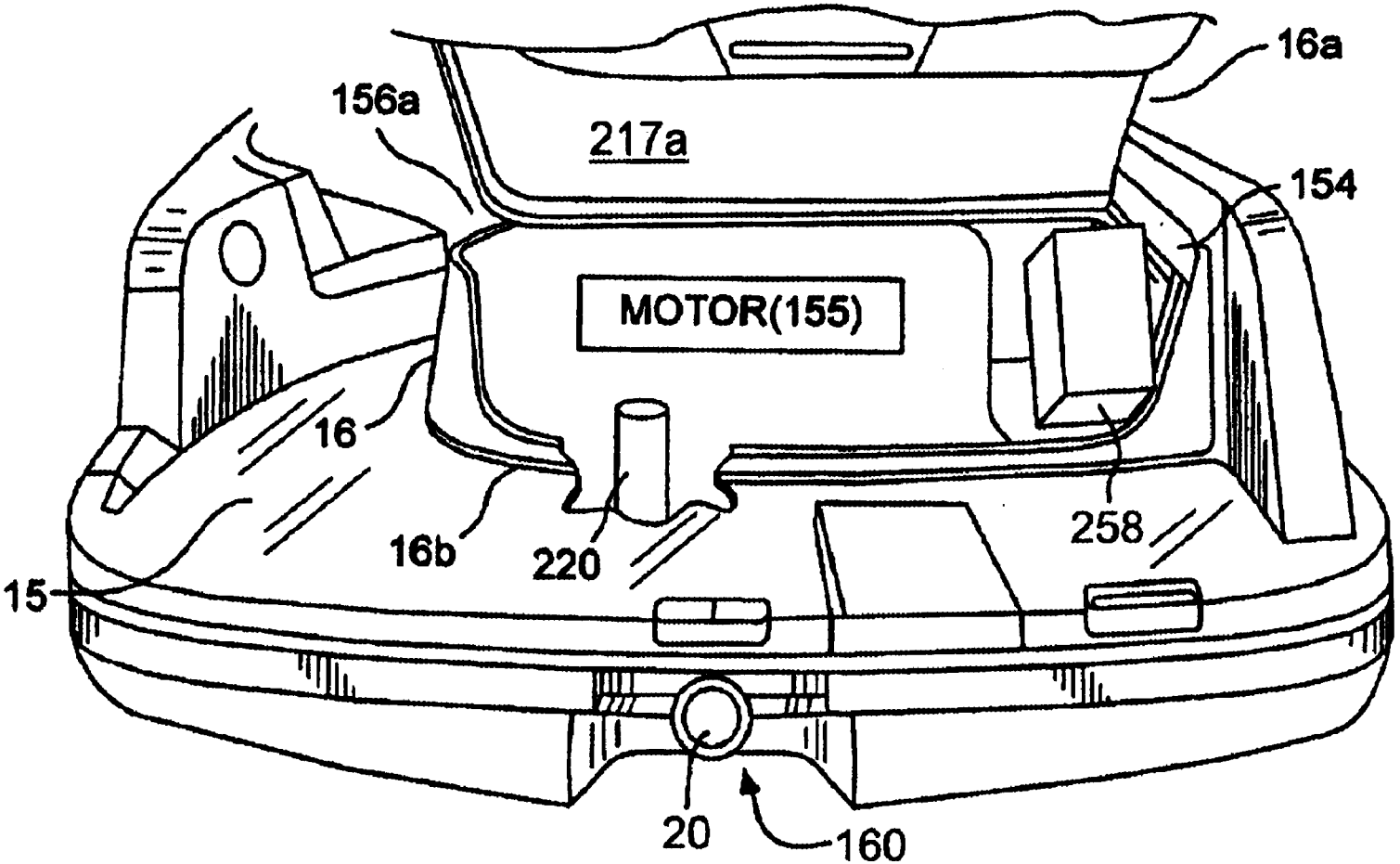
FIG. 19 is a partial rear view of the rear deck and engine compartment of the deck boat of the present invention.
Figure 20:
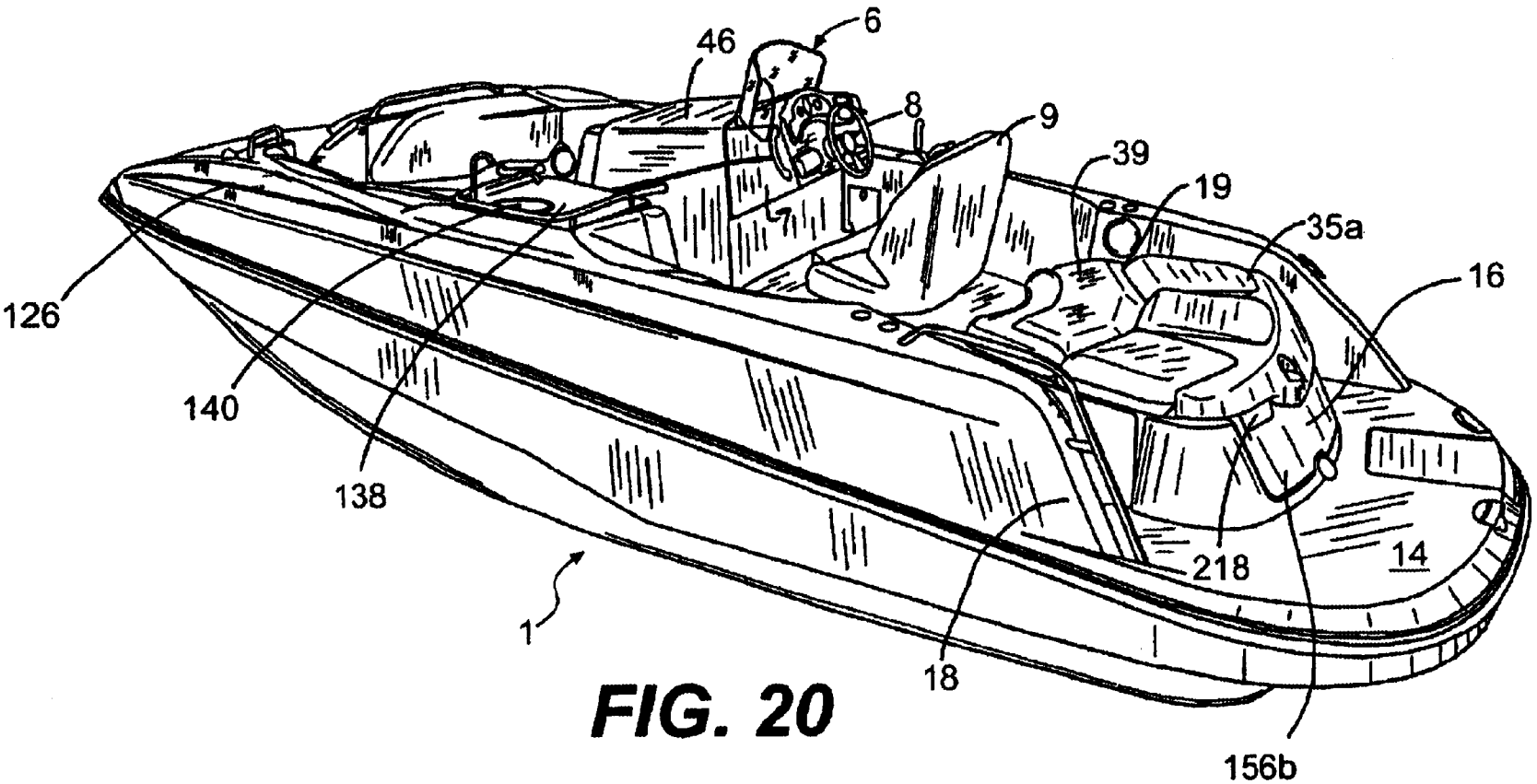
FIG. 20 is a perspective view, from the rear and port side of the deck boat of the present invention, showing the engine compartment closed.
Figure 21:
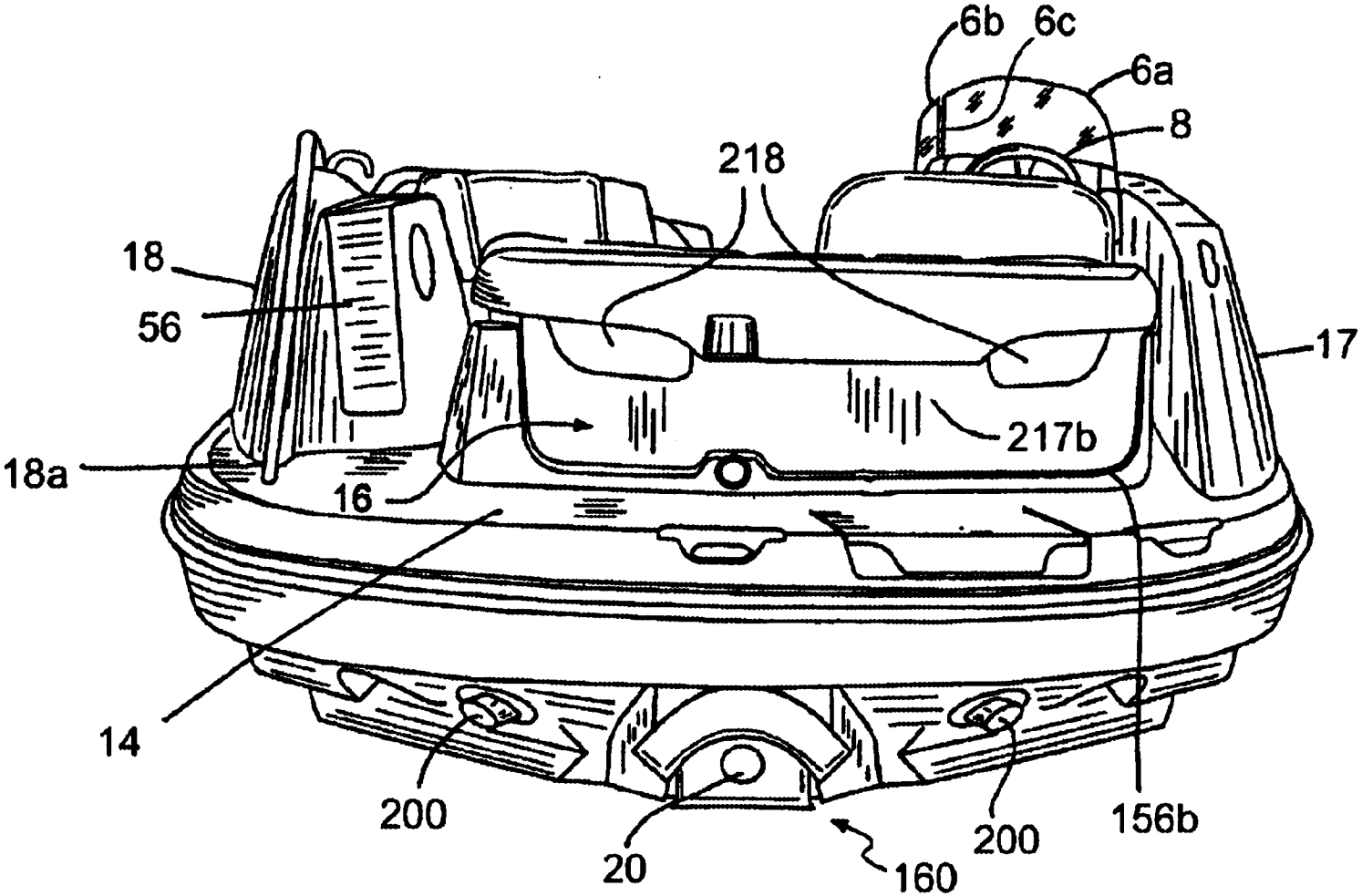
FIG. 21 is a rear view of the deck boat, illustrating various fetures of the engine compartment canopy.

FIGS. 19–21 illustrate an exemplary embodiment of the motor compartment canopy (16). The canopy (16), or motor accessway, is highly functional and permits easy access to the motor (155). The canopy (16) is adapted to cover an opening (154) in a portion of the upper hull (1*a*) of the deck boat (1). The canopy (16) includes a hood portion (16*a*), that is selectively changeable between an open position (156*a*) and a closed position (156*b*). In the closed position (156*b*), the sun deck (19), and seats (35) and (39), can be used. In the open position (156*a*), access to the motor (155) is provided. Because the access area to the motor (155) is so large, the compartment also permits access to an accommodating storage area (258) at the rear of the vessel, that can be used to store large items such as water skis. A ski pole attachment (220) or bracket (220) is also provided in the access area to the motor (155) for insertion of, for example, a ski pole so that a water skier may be pulled behind the deck boat (1).

Additionally, as illustrated FIGS. 19 and 20, and earlier in FIG. 3, the canopy (16) serves as a base (16*b*) for the sun deck area (19). The canopy (16) raises to the open position (156*a*) like the trunk of a car so that the entirety of the motor (155) is easily accessible. This greatly improves, for example, servicing of the motor (155) of the deck boat (1).

FIG. 21 provides a closer, more detailed view of the rear of canopy (16), which also functions as an air box for the motor (155). The trunk is made with two separate layers that are connected to one another. The interior layer (217*a*) is shown in FIG. 19 while the exterior layer (217*b*) is illustrated in FIG 21. When sandwiched together, the two layers (217*a*) and (217*b*) create an air space between them into which air is drawn from the exterior of the deck boat (1) through vents (218) located at the rear of the craft. The air passes between the two connected layers (217*a*) and (217*b*) in the trunk before reaching the motor (155). The two layers (217*a*) and (217*b*) prevent any water that enters the same vent (218) from reaching the motor (155) or the bilge area of the vessel. The vents (218) may also be used to provide ventilation for the interior of the boat.

Figure 22:
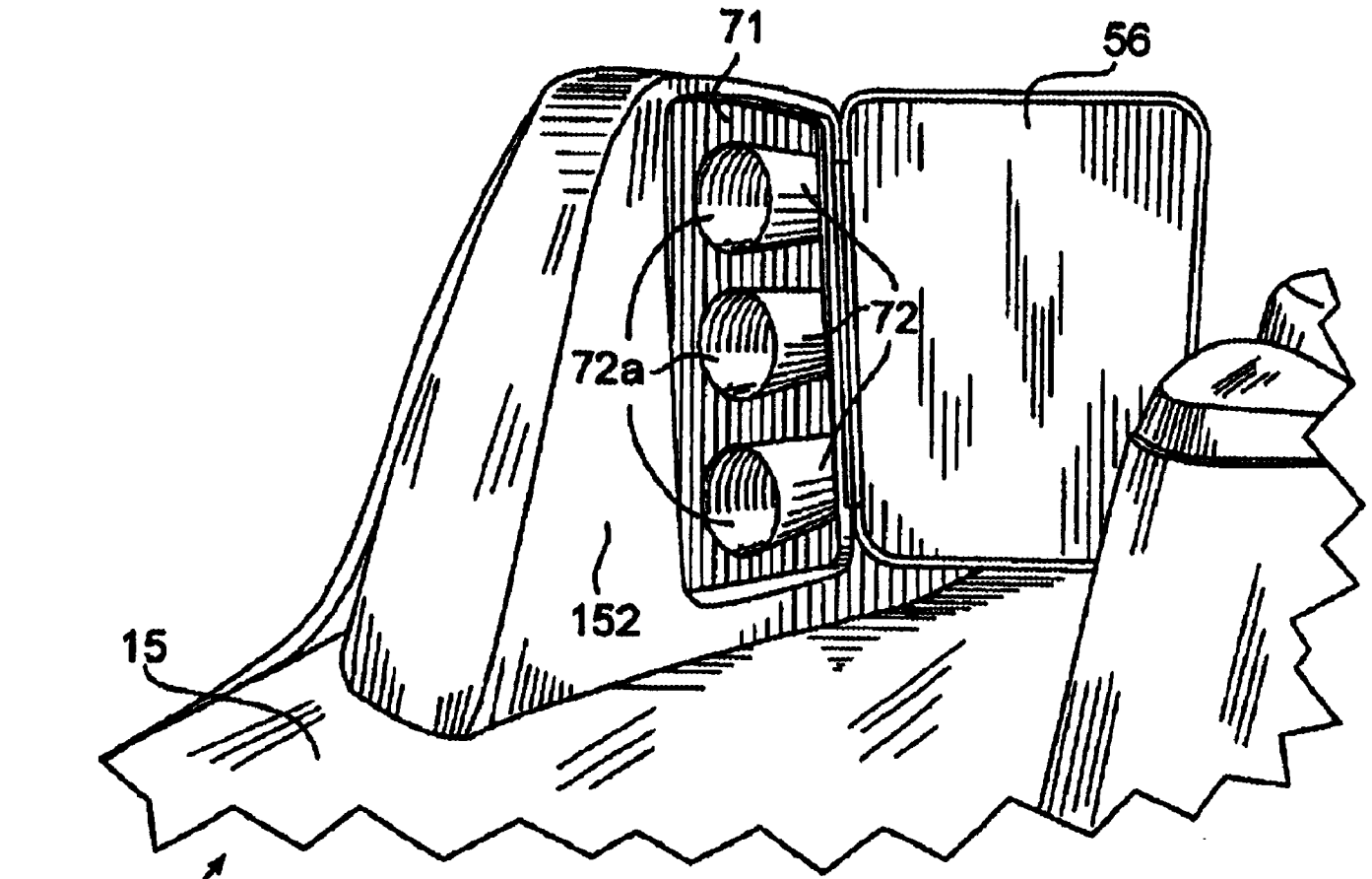
FIG. 22 is a perspective view of a storage compartment at the rear of the deck boat of the present invention.

FIG. 22 illustrates a rear storage compartment (71). A number of elongated cylindrical plastic tubes (72) are embedded in, and aligned with a side wall (152) of the deck boat (1). Openings (72*a*) are exposed for permitting storage of items such as fishing rods therein. A compartment door (56) can be closed to cover the area (71).

Figure 23:
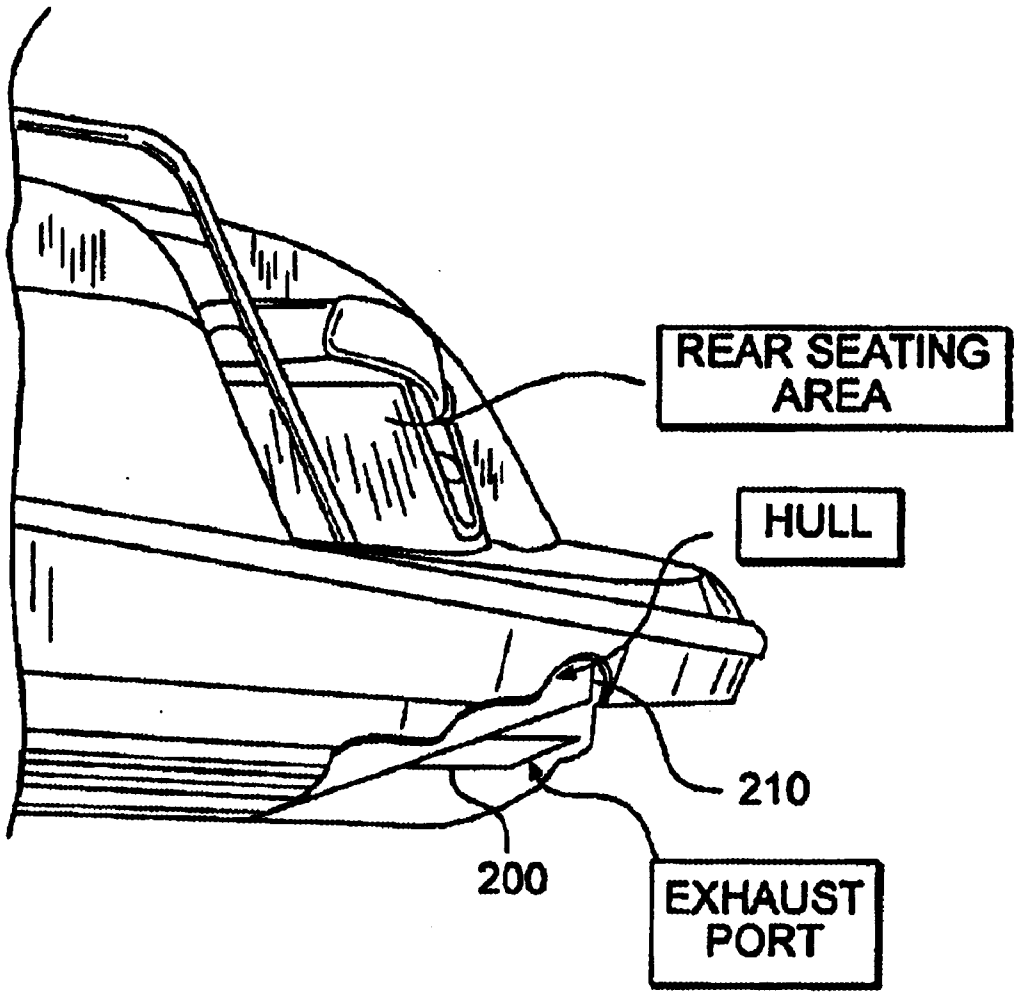
FIG. 23 is a partial cross-section of the rear of the deck boat, illustrating the position of the exhaust ports for the propulsion system.

FIG. 23 illustrates an exhaust port (200), from an exemplary embodiment of the present invention, which juts out past a rear hull (210) of the deck boat by a specific amount. This feature compensates for bubbling of the exhaust that occurs when the exhaust is forced into the water. By moving the exhaust tube (200) into the water a small distance, the bubbling effect is moved away from contact with the hull (1*a*) so that it cannot create vibrations that can be detected by passengers of the deck boat (1).

Figure 24:
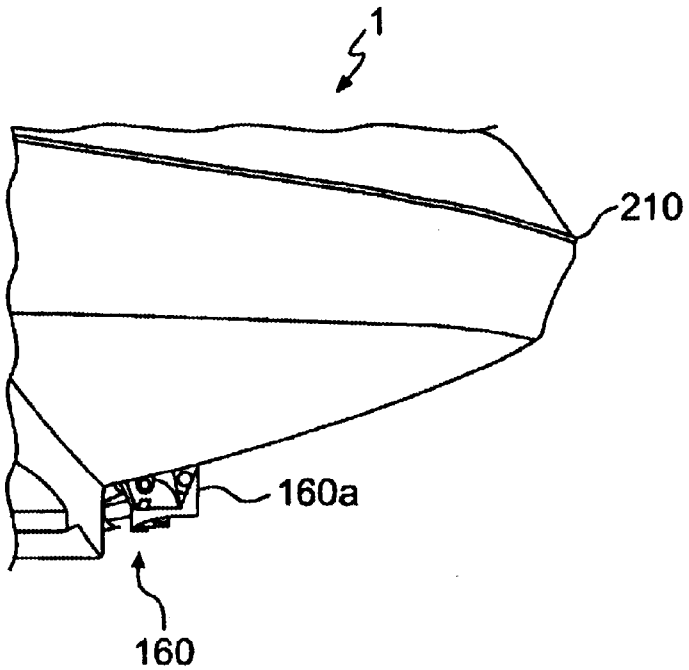
FIG. 24 is a view of a preferred location of the propulsion system for the deck boat of the present invention in relation to the stern thereof.

FIG. 24 illustrates another embodiment in which the jet nozzle outlet (160*a*) is moved closer to the bow of the craft. That is, the jet nozzle (160*a*) is positioned at a further distance from the rear hull (210) of the craft than on the conventional vehicle. In the preferred embodiment of the deck boat (1), the jet nozzle (160*a*) is positioned a distance about 527 mm from the rear hull (210) of deck boat (1). In still other embodiments of the present invention, the jet nozzle (160*a*) may be positioned anywhere in a range between about 500 and 550 mm from the rear hull (210) of the deck boat (1). This construction offers at least one advantage in that a person, when in the water, cannot hit his or her knees or feet against the jet propulsion unit (160*a*).

This feature also permits the construction of a boat with an inboard propeller (not shown), instead of a jet unit. With the propeller disposed such a large distance from the rear hull (210) of the craft, a person may be less likely to cut his or her feet on the propeller than on a traditional watercraft. Further, the position of the motor (155) and the jet nozzle (160*a*) permits the construction of a large (fore-aft) and low rear platform.

Figure 27:
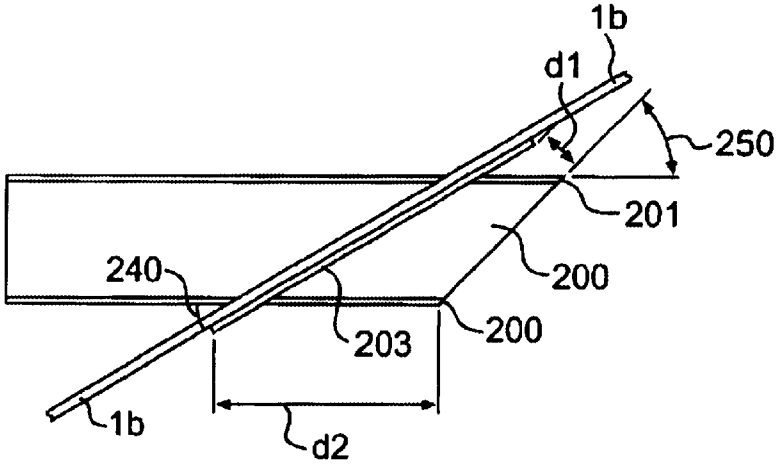
FIG. 27 is a cross-sectional side view illustration of the exhaust port illustrated in FIG. 26.
Figure 28:
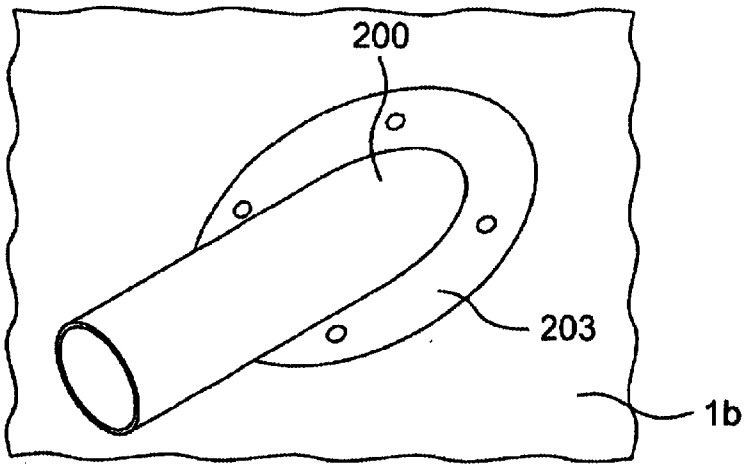
FIG. 28 is a perspective illustration of the exhaust port illustrated in FIG. 27.
Figure 26:
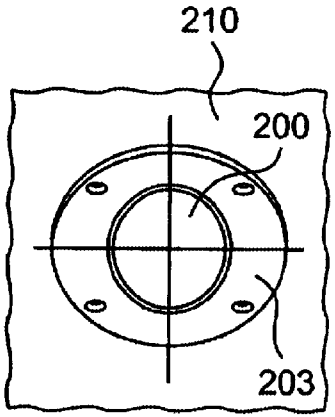
FIG. 26 in an end view of one of the exhaust ports at the rear of the deck boat.

The appearance of exhaust port (200) from the rear end (210) of the deck boat is illustrated in FIG. 26. FIG. 27 shows a side view of the exhaust port (200). Preferably, the top side (201) of the exhaust port extends outwardly a distance (d1) such that the end of the top side is about 29 mm from the hull (1*b*) (28.58 mm is shown in FIG. 27). The bottom side (202) of the exhaust port (200) preferably extends outwardly a distance (d2) so that the end of the bottom side (202) of the exhaust port (200) is about 140 mm from the hull (1*b*) (139.70 mm is shown in FIG. 27). A plate (203) surrounds exhaust port (200) and is attached to hull (1*b*), preferably by threaded fasteners (not shown). FIG. 28 illustrates plate (203) in greater detail. The plate is preferably disposed at an angle (240) of about 30 degrees with respect to the surface of the cylindrical exhaust port (200). The end of exhaust port (200) is preferably cut so that it forms an angle (250) with the surface of the cylindrical exhaust port (200) of about 45 degrees.

While the numbers called out above are preferred for the deck boat (1) of the present invention, they are not meant to be limiting in any way. For example, distance (d1) may be varied from 20 to 40 mm. Distance d2 may be varied from 120 to 160 mm. Angle (240) may be adjusted to fall within a range of 25 to 35 degrees. Similarly, angle (250) may be varied to fall within a range between 40 and 50 degrees.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A deck boat, comprising:

a main deck floor having at least two deck sections;

a seating area on each deck section; and a ramp area defining a sloping transition between the at least two deck sections, the ramp area being configured so accommodate an occupant's foot, wherein the sloping transition slopes from a rear section to a central section of the main deck floor and further comprising a curved entry area extending from the rear section to the central section of the deck boat along a path extending from a side of the boat to a position inward from that side, the curved entry area including at least a portion of the ramp area.

2. A deck boat according to claim 1, wherein the sloping transition defines at least one of a vertical drop and a vertical rise of greater than one inch.

3. A deck boat according to claim 2, wherein the at least one of a vertical drop and a vertical rise is about 2 inches.

4. A deck boat according to claim 1, wherein the at least two deck sections are substantially flat.

5. A deck boat, comprising:

a hull;

a seat configured for accommodating a driver and at least one passenger in side by side configuration;

wherein the seat is selectively switchable between a driving position and at least one relaxing position, further including a sun deck disposed rearwardly from the seat, wherein, when the seat is in the relaxing position, the seat mates with the sun deck to form a continuous seating module.

6. A deck boat according to claim 5, further comprising a swivel mount, wherein the seat pivots about the swivel mount when being selectively switched between the driving position and the relaxing position.

7. A deck boat according to clam 5, wherein, when the seat is in the relaxing position, the seat is disposed about 90° from the driving position so that it faces toward a side of the boat.

8. A deck boat, comprising:

a main deck;

a recess integrally formed in and surrounded by the main deck, the recess having a bottom and being configured for receiving a predetermined quantity of water;

a floor suitable to be walked on by a rider of the boat defined by the main deck and the bottom of the recess; and a faucet adapted for filling the recess with the predetermined quantity of water.

9. A deck boat according to claim 8, wherein the recess is positioned in at least a bow portion of the boat.

10. A deck boat according to claim 8 further comprising a sump disposed below the recess permitting the water to drain thereinto, and a pump connected to the sump for evacuating water from the sump.

11. A deck boat according to claim 10, further comprising a spraying mechanism within the sump, operatively connected to the pump, and adapted for (i) receiving water from the sump and (ii) spraying the water from the sump into the main deck.

12. A deck boat according to claim 11, wherein the spraying mechanism sprays the water into the air in a form of at least one of a water column, multiple water streams, or a mist.

13. The deck boat according to claim 8, wherein the recess is formed in a lowest portion of the main deck.

14. The deck boat according to claim 8, wherein the recess has a depth of no more than 5 inches.

15. A deck boat, comprising:

a main deck portion;

at least one second deck portion arranged adjacent to the main deck portion;

a passageway for accommodating passage between the main deck portion and the at least one second deck portion, the passageway including a ramp connecting the main deck portion and the at least one second deck portion, and first and second wall portions positioned along opposite sides of the ramp; and a door hingedly mounted to one of the first and second wall portions, the door being configured to (i) separate the main deck portion from the at least one second deck portion, and (ii) form a seal with the ramp and the first and second wall portions when configured to separate the main deck portion from the at least one second deck portion.

16. A deck boat according to claim 15, wherein the door engages a locking mechanism when forming the seal.

17. A deck boat, comprising:

a main deck;

a forward seating area and a rearward seating area;

a passage between the forward seating area and the rearward seating area; and at least one second deck integrally formed with the main deck and rearwardly disposed from the main deck, the second deck having a substantially flat surface;

wherein the second deck is configured to allow a person to board the boat directly from water and the main deck is below the at least one second deck.

18. A deck boat according to claim 17, wherein the second deck portion is positioned at a stern of the boat and the substantially flat surface is disposed above a waterline of the boat at a sufficient distance to discourage ingress of water onto the second deck portion while facilitating ingress of a person onto the boat from the water.

19. A deck boat, comprising:

a bow area;

a cockpit area rearward of the bow area;

a main deck extending from the cockpit area to the bow area;

a recess area disposed lower than the main deck in the bow area;

a cockpit seat disposed in the cockpit area on the main deck, the cockpit seat's height being selected in relation to the main deck; and at least one passenger seat disposed adjacent the recess area;

wherein the at least one passenger seat is positioned below the cockpit seat.

20. A deck boat according to claim 19 further comprising:

port side and starboard side gunwales, each defining character lines;

wherein the at least one passenger seat comprises a seat bottom and a seat back;

wherein the at least one passenger seat is positioned adjacent to one of the gunwales; and wherein the seat back of the at least one passenger seat extends above the character line.

21. A deck boat according to claim 19 wherein the at least one passenger seat further includes a headrest disposed on top of the at least one passenger seat.

22. A deck boat according to claim 21 wherein the headrest is extendable upwardly from the at least one passenger seat.

23. A deck boat, comprising:

a hull;

a deck mounted to the hull; and a retractable privacy compartment mounted to the deck, the privacy compartment comprising:

a rigid member movably mounted to the deck, the rigid member having a first portion and a second portion;

the rigid member having an open position that accommodates entry of an averaged sized adult therein, wherein the first portion defines a wall of the privacy compartment and the second portion defines a roof of the privacy compartment, the rigid member having a closed position wherein the first portion and the second portion conceal the privacy compartment.

24. A deck boat according to claim 23, wherein the privacy compartment includes at least one of a toilet area, a changing area, or a shower.

25. A deck boat according to claim 23, wherein the privacy compartment is positioned forward of a steering console.

26. A deck boat according to claim 23, wherein the privacy compartment further comprises:

a flexible curtain connected to the rigid member and configured to provide (i) entry into the privacy compartment and (ii) privacy when the compartment is open.

27. A deck boat according to claim 26, wherein the flexible curtain is made of a fabric.

28. A deck boat according to claim 27, wherein the fabric is vented.

29. A deck boat according to claim 27, wherein the flexible curtain includes battons adapted to prevent the flexible curtain from billowing when the privacy compartment is being closed.

30. A deck boat according to claim 23, wherein the privacy compartment is adapted to provide privacy for a standing adult, the standing adult being of average size.

31. A deck boat according to claim 23, wherein the rigid member is substantially shaped according to at least one of an L-shape and a triangular-shape.

32. A deck boat according to claim 23, wherein the rigid member includes a number of overlapping sides.

33. A deck boat according to claim 32, wherein the overlapping sides telescope from the closed position to the open position.

34. A deck boat, comprising:

a hull; and a deck mounted on the hull, the deck including a raised section having an upper surface, the upper surface having a front portion and a rear portion;

wherein the rear portion is selectively changeable between a first position and at least one second position so that the front portion and the rear portion (i) form a substantially flat surface when the rear portion is in the first position and (ii) form a seat when the rear portion is in the at least one second position, the front portion forming a seat bottom and the rear portion forming a seat back and the rear portion includes a number of sections, each section forming a separate seat back when the rear portion is in the at least one second position.

35. A deck boat according to claim 34, further comprising a locking mechanism disposed between the rear portion and the upper surface to lock the rear portion in the at least one second position.

36. A deck boat according to claim 34, wherein each of the number of sections is independently changeable between the first and the at least one second position.

37. A deck boat according to claim 34, wherein the number of sections includes three sections.

38. The deck boat according to claim 34, wherein the upper surface is padded.

39. The deck boat according to claim 34, wherein the upper surface is at least part of a motor compartment cover configured to cover a motor.

40. A deck boat, comprising:

a hull;

a deck mounted on the hull;

a motor positioned between the hull and the deck;

the deck having an opening allowing access to the motor;

a canopy pivotally attached to the deck and having a closed position wherein at least a part of the canopy conceals the opening and an open position wherein the canopy permits the opening to be accessed by a person rearward of the opening and facing in the direction of a front of the boat.

41. A deck boat according to claim 40, wherein at least a portion of the canopy is L-shaped.

42. A deck boat according to claim 40, further comprising:

a chamber configured for housing the motor; and at least one storage compartment positioned adjacent the chamber configured for housing the motor.

43. A deck boat according to claim 40, wherein the canopy forms an airbox adapted to facilitate an air exchange for at least one of the motor and an interior of the deck boat.

44. A deck boat according to claim 43, wherein at least two layers of material are disposed from one another a predetermined distance to form the airbox, the canopy including vents permitting air to enter the air box but discouraging water from entering the air box.

45. A deck boat, comprising:

a hull;

a deck mounted on the hull; and at least one exterior lighting fixture recessed in the deck, the at least one exterior lighting fixture being an integral unit having a first light adapted to illuminate a first exterior area of the boat, and a second light adapted for illuminating a second exterior area of the boat, the first light and the second light being on the same side of a longitudinal centerline of the boat.

46. A deck boat according to claim 45, wherein the first light and the second light include at least one of a docking light and a courtesy light.

47. A deck boat according to claim 45, wherein the at least one exterior lighting fixture is positioned at the bow of the boat.

48. A deck boat according to claim 47, wherein the at least one exterior lighting fixture comprises two exterior lighting fixtures.

49. A deck boat, comprising:

a hull;

a deck mounted on the hull;

a steering console on the deck including a top portion;

a windshield disposed on the top portion of the steering console, the windshield including, a main portion extending laterally across the top portion, and at least one side portion attached to a lateral side of the main portion, wherein the at least one side portion is movable between a first position and a second position and is configured to extend the windshield beyond the main portion.

50. A deck boat according to claim 49, wherein the main portion is selectively changeable between the first position and the second position.

51. A deck boat according to claim 50, wherein, in the first position of the main portion, the main portion of the windshield is substantially horizontal.

52. A deck boat according to claim 50, wherein, in the second position of the main portion, the main portion of the windshield is substantially upright.

53. A deck boat according to claim 49, wherein the side portion is hingedly attached to a lateral side of the main portion.

54. A deck boat, comprising:

a bull having a stern;

a deck mounted to the hull, the deck including a rear deck at the stern for facilitating entry from aft locations; and a jet drive unit mounted to the hull, the jet drive unit including a nozzle having an outlet, the outlet being positioned a predetermined distance forward of the stern of the hull, wherein the predetermined distance is between about 500 and 550 mm.

55. The deck boat according to claim 54, wherein the predetermined distance is about 527 mm.

56. A deck boat, comprising:

a hull;

a deck mounted to the hull;

an engine compartment defined between the hull and the deck;

a canopy pivotally attached to the deck and having a closed position wherein at least a part of the canopy conceals the engine compartment and an open position wherein the canopy engine permits the compartment to be accessed; and a ski pole attachment for receiving a ski pole therein, the attachment being positioned within the engine compartment.

* * * * *